US011959670B2

(12) United States Patent
Ishida et al.

(10) Patent No.: US 11,959,670 B2
(45) Date of Patent: Apr. 16, 2024

(54) REFRIGERANT COMPRESSOR AND FREEZER INCLUDING SAME

(71) Applicant: Panasonic Intellectual Property Management Co., Ltd., Osaka (JP)

(72) Inventors: Yoshinori Ishida, Kyoto (JP); Noboru Iida, Osaka (JP); Ko Inagaki, Osaka (JP); Hiroyuki Kawano, Shiga (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 99 days.

(21) Appl. No.: 17/459,151

(22) Filed: Aug. 27, 2021

(65) Prior Publication Data

US 2021/0389030 A1 Dec. 16, 2021

Related U.S. Application Data

(63) Continuation of application No. 16/347,149, filed as application No. PCT/JP2017/041314 on Nov. 16, 2017, now Pat. No. 11,143,442.

(30) Foreign Application Priority Data

Nov. 18, 2016 (JP) ..... 2016-224662
Nov. 21, 2016 (JP) ..... 2016-225644

(51) Int. Cl.
*F25B 31/02* (2006.01)

(52) U.S. Cl.
CPC ..... *F25B 31/026* (2013.01)

(58) Field of Classification Search
CPC ..... F04B 2201/1207; F04B 2201/1209; F25B 31/026
See application file for complete search history.

(56) References Cited

U.S. PATENT DOCUMENTS 4,474,484 A * 10/1984 MacInnes ..... F16C 33/1085 384/901
4,870,893 A * 10/1989 Takahashi ..... F04B 27/1063 417/269

(Continued)

FOREIGN PATENT DOCUMENTS

CN 103069166 4/2013
JP S49-13378 Y 4/1974

(Continued)

OTHER PUBLICATIONS

International Search Report of PCT/JP2017/041314, dated Feb. 13, 2018, 5 pages.

(Continued)

*Primary Examiner* — Henry T Crenshaw
(74) *Attorney, Agent, or Firm* — HSML P.C.

(57) ABSTRACT

The present invention includes: an electric component; a compression component driven by the electric component; and a sealed container accommodating the electric component and the compression component. The compression component includes: a shaft part rotated by the electric component; and a bearing part slidingly contacting the shaft part. A film having hardness equal to or more than hardness of a sliding surface of the bearing part is provided on a sliding surface of the shaft part. The sliding surface of the bearing part includes a curved-surface portion having an inner diameter that continuously increases, or the sliding surface of the shaft part includes a curved-surface portion having an outer diameter that continuously decreases.

9 Claims, 16 Drawing Sheets

(56) References Cited

U.S. PATENT DOCUMENTS

| | | | | |
|---|---|---|---|---|
| 5,165,870 | A | 11/1992 | Sato | |
| 5,531,574 | A | 7/1996 | Honma | |
| 5,762,164 | A | 6/1998 | Krueger et al. | |
| 6,168,403 | B1 | 1/2001 | Bush | |
| 6,171,076 | B1 * | 1/2001 | Gannaway | F04C 18/3442 417/244 |
| 6,416,296 | B1 | 7/2002 | Nunes, Jr. et al. | |
| 6,749,339 | B1 | 6/2004 | Murabe et al. | |
| 2001/0026766 | A1 * | 10/2001 | Terai | F04C 29/028 418/94 |
| 2008/0145252 | A1 * | 6/2008 | Ku | F04C 18/3442 418/54 |
| 2011/0052375 | A1 | 3/2011 | Underbakke | |
| 2013/0195707 | A1 * | 8/2013 | Kozuma | F04C 29/0071 418/55.1 |
| 2014/0294643 | A1 | 10/2014 | Koyama et al. | |
| 2014/0318900 | A1 | 10/2014 | Krug Rocha et al. | |
| 2015/0354552 | A1 | 12/2015 | Nagaki et al. | |
| 2015/0369526 | A1 | 12/2015 | Kawano et al. | |
| 2023/0137074 | A1 * | 5/2023 | Park | F04C 2/321 418/60 |

FOREIGN PATENT DOCUMENTS

| | | | |
|---|---|---|---|
| JP | S51-122812 | A | 10/1976 |
| JP | S55-4958 | B | 2/1980 |
| JP | H7-4355 | | 1/1995 |
| JP | H7-238885 | | 9/1995 |
| JP | H8-93672 | A | 4/1996 |
| JP | H11-247761 | | 9/1999 |
| JP | 2001-295766 | | 10/2001 |
| JP | 2003-3959 | A | 1/2003 |
| JP | 2006-2823 | A | 1/2006 |
| JP | 2008-261353 | A | 10/2008 |
| JP | 2011-027074 | | 2/2011 |
| JP | 2016-17475 | A | 2/2016 |
| KR | 2004-0020557 | | 3/2004 |
| WO | 01/18413 | | 3/2001 |
| WO | 2007/126230 | | 11/2007 |

OTHER PUBLICATIONS

The Extended European Search Report of European patent application No. 17872369.8, dated Oct. 16, 2019, 12 pages.

Office Action issued for Chinese Patent Application No. 201780071219.2, dated Sep. 21, 2020, 15 pages including machine translation.

* cited by examiner

REFRIGERANT COMPRESSOR AND FREEZER INCLUDING SAME

TECHNICAL FIELD

The present invention relates to a refrigerant compressor for use in a refrigerator, an air conditioner, and the like, and a freezer including the refrigerant compressor.

BACKGROUND ART

In order to reduce the use of fossil fuels from the viewpoint of the protection of the global environment, highly efficient refrigerant compressors have been developed in recent years. Therefore, according to a sealed compressor of PTL 1, cast iron subjected to an insoluble film treatment using, for example, manganese phosphate is used as one of sliding portions of a compression machine, and carbon steel is used as the other sliding portion. According to a rotary compressor of PTL 2, an iron-based sintered alloy subjected to a soft-nitriding treatment is used as at least one of a roller and a vane plate which slide on each other.

CITATION LIST

Patent Literature

PTL 1: Japanese Laid-Open Patent Application Publication No. 7-238885

PTL 2: Japanese Examined Patent Application Publication No. 55-4958

SUMMARY OF INVENTION

Technical Problem

For example, a typical refrigerant compressor shown in FIG. 16 includes sliding members, such as a main shaft 8 that rotates and a main bearing 14 supporting the main shaft 8. When the main shaft 8 starts rotating relative to the main bearing 14, large frictional resistance force is generated between the main shaft 8 and the main bearing 14. Further, in recent years, in order to improve the efficiency of the refrigerant compressor, the viscosity of lubricating oil 2 supplied between the sliding portions is lowered, and the dimensions of the sliding portions are shortened. Thus, lubrication conditions are becoming severe. Therefore, for example, even when the manganese phosphate-based film is provided on the sliding portion as in PTL 1, the film quickly abrades, and an input to the refrigerant compressor becomes high. On this account, the efficiency of the refrigerant compressor deteriorates.

Further, in order to improve the efficiency of the refrigerant compressor, the reduction in speed (for example, less than 20 Hz) by inverter drive is being promoted in recent years. Under such circumstances, an oil film between the sliding portions becomes thin, so that contact between the sliding portions by a large number of minute projections on the surfaces frequently occurs, and the input to the refrigerant compressor becomes high. Further, for example, when the hard soft-nitriding-treated film is provided on the sliding portion as in PTL 2, the film coats the projections on the sliding portion, so that the progress of the abrasion of the projections slows down, and the high input state continues for a long period of time. Thus, the efficiency of the refrigerant compressor deteriorates.

The present invention was made in light of these, and an object of the present invention is to provide a refrigerant compressor whose efficiency is prevented from deteriorating, and a freezer including the refrigerant compressor.

Solution to Problem

To achieve the above object, a refrigerant compressor of the present invention includes: an electric component; a compression component driven by the electric component to compress a refrigerant; and a sealed container accommodating the electric component and the compression component. The compression component includes: a shaft part rotated by the electric component; and a bearing part slidingly contacting the shaft part such that the shaft part is rotatable. A film having hardness equal to or more than hardness of a sliding surface of the bearing part is provided on a sliding surface of the shaft part. The sliding surface of the bearing part includes a curved-surface portion having an inner diameter that continuously increases in a curved shape toward an end of the bearing part in a center axis direction of the bearing part, or the sliding surface of the shaft part includes a curved-surface portion having an outer diameter that continuously decreases in a curved shape toward an end of the shaft part in a center axis direction of the shaft part.

Another refrigerant compressor of the present invention includes: an electric component; a compression component driven by the electric component to compress a refrigerant; and a sealed container accommodating the electric component and the compression component. The compression component includes: a main shaft rotated by the electric component; and a main bearing supporting the main shaft such that the main shaft is rotatable. A film having hardness equal to or more than hardness of a sliding surface of the main bearing is provided on a sliding surface of the main shaft. At least one of one end portion of the main bearing and the other end portion of the main bearing includes a low-rigidity portion that is lower in rigidity than an intermediate portion of the main bearing, the intermediate portion being located between the one end portion and the other end portion.

A freezer of the present invention includes a heat radiator, a decompressor, a heat absorber, and the above refrigerant compressor.

Advantageous Effects of Invention

By the above configurations, the present invention can provide the refrigerant compressor whose efficiency is prevented from deteriorating, and the freezer including the refrigerant compressor.

DESCRIPTION OF EMBODIMENTS

Figure 1:
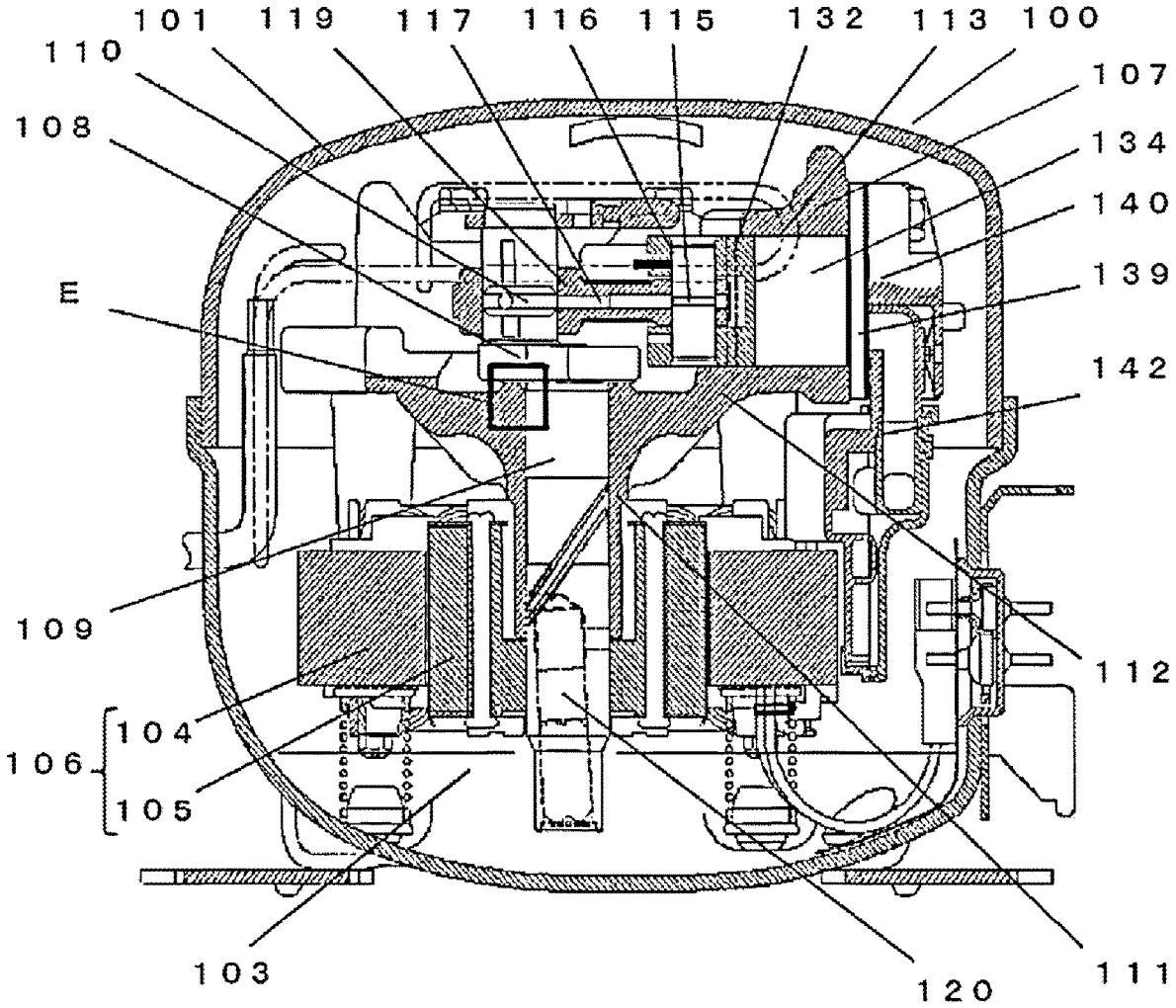
FIG. 1 is a sectional view schematically showing a refrigerant compressor according to Embodiment 1 of the present invention.

A refrigerant compressor according to a first aspect includes: an electric component; a compression component driven by the electric component to compress a refrigerant; and a sealed container accommodating the electric component and the compression component. The compression component includes: a shaft part rotated by the electric component; and a bearing part slidingly contacting the shaft part such that the shaft part is rotatable. A film having hardness equal to or more than hardness of a sliding surface of the bearing part is provided on a sliding surface of the shaft part. The sliding surface of the bearing part includes a curved-surface portion having an inner diameter that continuously increases in a curved shape toward an end of the bearing part in a center axis direction of the bearing part, or the sliding surface of the shaft part includes a curved-surface portion having an outer diameter that continuously decreases in a curved shape toward an end of the shaft part in a center axis direction of the shaft part.

With this, even when the shaft part inclines in the bearing part, local contact by one-side hitting between the shaft part and the bearing part is eased by the curved-surface portion. Therefore, the decrease in thickness of the oil film and the break of the oil film are suppressed between the shaft part and the bearing part, and therefore, the refrigerant compressor whose efficiency is prevented from deteriorating can be provided.

The refrigerant compressor according to a second aspect may be configured such that in the first aspect, the curved-surface portion is formed in a shape having a curvature radius that decreases as it approaches the end in the center axis direction. With this, a contact area between the shaft part and the bearing part is made large, so that the decrease in thickness of the oil film and the break of the oil film can be suppressed between the shaft part and the bearing part.

The refrigerant compressor according to a third aspect may be configured such that in the first or second aspect, the slicing surface of the bearing part is arranged so as not to be opposed to a corner of the sliding surface of the shaft part or a corner of an extended surface extended from the sliding surface of the shaft part, the extended surface being equal in diameter to the sliding surface of the shaft part. With this, the corner of the shaft part does not contact the sliding surface, so that the local contact between the shaft part and the bearing part can be reduced. Therefore, the decrease in thickness of the oil film and the break of the oil film can be suppressed between the shaft part and the bearing part.

The refrigerant compressor according to a fourth aspect may be configured such that in any one of the first to third aspects, the curved-surface portion of the bearing part is formed such that in a plane passing through a center axis of the bearing part, a ratio of a dimension B of the curved-surface portion of the bearing part in a direction perpendicular to the center axis direction of the bearing part to a dimension A of the curved-surface portion of the bearing part in the center axis direction of the bearing part is $1/5000$ or more and $1/50$ or less. With this, the contact area between the shaft part and the bearing part is made large, so that the decrease in thickness of the oil film and the break of the oil film can be suppressed between the shaft part and the bearing part.

The refrigerant compressor according to a fifth aspect may be configured such that in the first or second aspect, the sliding surface of the shaft part is arranged so as not to be opposed to a corner of the sliding surface of the bearing part or a corner of an extended surface extended from the sliding surface of the bearing part, the extended surface being equal in diameter to the sliding surface of the bearing part. With this, the corner of the shaft part does not contact the sliding surface, so that the local contact between the shaft part and the bearing part can be reduced. Therefore, the decrease in thickness of the oil film and the break of the oil film can be suppressed between the shaft part and the bearing part.

The refrigerant compressor according to a sixth aspect may be configured such that in any one of the first to third aspects, the curved-surface portion of the shaft part is formed such that in a plane passing through a center axis of the shaft part, a ratio of a dimension D of the curved-surface portion of the shaft part in a direction perpendicular to the center axis direction of the shaft part to a dimension C of the curved-surface portion of the shaft part in the center axis direction of the shaft part is $1/5000$ or more and $1/50$ or less. With this, the contact area between the shaft part and the bearing part is made large, so that the decrease in thickness of the oil film and the break of the oil film can be suppressed between the shaft part and the bearing part.

The refrigerant compressor according to a seventh aspect may be configured such that in any one of the first to sixth aspects, the shaft part includes a main shaft and an eccentric shaft arranged eccentrically with respect to the main shaft, and the bearing part includes a main bearing supporting the main shaft such that the main shaft is rotatable and an eccentric hearing supporting the eccentric shaft such that the eccentric shaft is rotatable. With this, the decrease in thickness of the oil film and the break of the oil film can be suppressed between the main shaft and the main bearing and/or between the eccentric shaft and the eccentric bearing.

The refrigerant compressor according to an eighth aspect includes: an electric component; a compression component driven by the electric component to compress a refrigerant; and a sealed container accommodating the electric component and the compression component. The compression component includes a main shaft rotated by the electric component and a main bearing supporting the main shaft such that the main shaft is rotatable. A film having hardness equal to or more than hardness of a sliding surface of the main bearing is provided on a sliding surface of the main shaft. At least one of one end portion of the main bearing and the other end portion of the main bearing includes a low-rigidity portion that is lower in rigidity than an intermediate portion of the main bearing, the intermediate portion being located between the one end portion and the other end portion.

With this, when a load is applied from the main shaft to the main bearing, the end portion of the main bearing which portion is low in rigidity elastically deforms. Therefore, the local contact by the one-side hitting between the main shaft and the main bearing is eased, and the decrease in thickness of the oil film and the break of the oil film are suppressed between the main shaft and the main bearing. On this account, the refrigerant compressor whose efficiency is prevented from deteriorating can be provided.

The refrigerant compressor according to a ninth aspect may be configured such that in the eighth aspect, a thickness of the low-rigidity portion in a radial direction of the main bearing is smaller than a thickness of the intermediate portion in the radial direction of the main bearing. With this, the rigidity of the end portion of the main bearing can be made lower than the rigidity of the intermediate portion of the main bearing without using an additional part, and therefore, the cost increase can be suppressed.

The refrigerant compressor according to a tenth aspect may be configured such that in the eighth aspect, the low-rigidity portion is provided at a region of the end portion of the main bearing to which region a maximum load is applied by the main shaft. With this, a processed region can be reduced, and the cost increase can be suppressed.

The refrigerant compressor according to an eleventh aspect may further include: in any one of the eighth to tenth aspects, a crank shaft including the main shaft; a cylinder block including the main bearing; and a cylindrical ball bearing arranged on a thrust surface of the cylinder block and supporting the crank shaft in a center axis direction of the main bearing. The end portion of the main bearing may have a cylindrical shape projecting from the thrust surface and may be divided into a first end portion and a second end portion in a radial direction of the main bearing by a slit groove having a cylindrical shape, the first end portion being relatively large in diameter, the second end portion being relatively small in diameter and arranged closer to a center axis of the main bearing than the first end portion. The first end portion may be inserted into the ball bearing. The second end portion may support the main shaft such that the main shaft is rotatable. The second end portion may constitute the low-rigidity portion that is lower in rigidity than the intermediate portion. With this, the first end portion can hold the ball bearing without being influenced by the deformation of the second end portion by the slit groove.

The refrigerant compressor according to a twelfth aspect may be configured such that in any one of the first to eleventh aspects, the electric component is configured to be inverter-driven at a plurality of operation frequencies. With this, the refrigerant compressor whose efficiency is prevented from deteriorating even when the refrigerant compressor is rotated at a low speed by inverter drive can be provided.

A freezer according to a thirteenth aspect includes a heat radiator, a decompressor, a heat absorber, and the refrigerant compressor according to any one of the first to twelfth aspects. Since the freezer includes the refrigerant compressor whose efficiency is prevented from deteriorating, the power consumption of the freezer can be reduced.

Hereinafter, embodiments of the present invention will be explained with reference to the drawings. It should be noted that the present invention is not limited to these embodiments. In the following explanation and the drawings, the same reference signs are used for the same or corresponding components, and a repetition of the same explanation is avoided.

Embodiment 1

Configuration of Refrigerant Compressor

As shown in FIG. 1, a refrigerant compressor 100 according to Embodiment 1 includes a sealed container 101. The sealed container 101 is filled with R600a as refrigerant gas, and mineral oil as lubricating oil 103 is stored in a bottom portion of the sealed container 101.

The sealed container 101 accommodates an electric component 106 and a compression component 107. The electric component 106 includes a stator 104 and a rotor 105 that rotates relative to the stator 104. The compression component 107 is driven by the electric component 106 to compress a refrigerant. The compression component 107 is, for example, a reciprocating mechanism and includes a crank shaft 108, a cylinder block 112, and a piston 132.

The crank shaft 108 includes a main shaft 109 and an eccentric shaft 110. The main shaft 109 is a shaft part having a columnar shape. A lower portion of the main shaft 109 is press-fitted and fixed to the rotor 105. An oil supply pump 120 communicating with the lubricating oil 103 is provided at a lower end of the main shaft 109. The eccentric shaft 110 is a shaft part having a columnar shape and is arranged eccentrically with respect to the main shaft 109.

The cylinder block 112 is made of, for example, an iron-based material, such as cast iron, and includes a cylinder bore 113 and a main bearing 111. The cylinder bore 113 has a cylindrical shape and includes an internal space. An end surface of the cylinder bore 113 is sealed by a valve plate 139.

The main bearing 111 is a bearing part having a cylindrical shape. An inner peripheral surface of the main bearing 111 supports the main shaft 109 such that the main shaft 109 is rotatable. The main bearing 111 is a journal bearing supporting a radial load of the main shaft 109. Therefore, the inner peripheral surface of the main bearing 111 and an outer peripheral surface of the main shaft 109 are opposed to each other, and the main shaft 109 slides on the inner peripheral surface of the main bearing 111. As above, a portion of the inner peripheral surface of the main bearing 111 and a portion of the outer peripheral surface of the main shaft 109 which portions slide on each other are sliding surfaces. The main bearing 111 including the sliding surface and the main shaft 109 including the sliding surface constitute a pair of sliding members.

One end portion of the piston 132 is inserted in the internal space of the cylinder bore 113 such that the piston 132 can reciprocate by the rotation of the main shaft 109. With this, a compression chamber 134 surrounded by the cylinder bore 113, the valve plate 139, and the piston 132 is formed. Further, a piston pin hole 116 is provided at the other end portion of the piston 132.

The piston pin 115 has a substantially cylindrical shape and is arranged parallel to the eccentric shaft 110. The piston pin 115 is locked to the piston pin hole 116 so as not to be rotatable. A connecting rod (coupler) 117 is constituted by an aluminum casting. The eccentric bearing 119 is provided at one end portion of the connecting rod 117, and the piston 132 is coupled to the other end portion of the connecting rod 117 through the piston pin 115. With this, the connecting rod 117 couples the piston 132 and the eccentric shaft 110 supported by the eccentric bearing 119.

The eccentric bearing 119 is a bearing part having a cylindrical shape. An inner peripheral surface of the eccentric bearing 119 supports the columnar eccentric shaft 110. The eccentric bearing 119 is a journal bearing supporting a radial load of the eccentric shaft 110. Therefore, the inner peripheral surface of the eccentric bearing 119 and an outer peripheral surface of the eccentric shaft 110 are opposed to each other, and the eccentric shaft 110 slides on the inner peripheral surface of the eccentric bearing 119. A portion of the inner peripheral surface of the eccentric bearing 119 and a portion of the outer peripheral surface of the eccentric shaft 110 which portions slide on each other are sliding surfaces. The eccentric bearing 119 including the sliding surface and the eccentric shaft 110 including the sliding surface constitute a pair of sliding members.

A cylinder head 140 is fixed to the valve plate 139 at an opposite side of the cylinder bore 113. The cylinder head 140 covers an ejection hole of the valve plate 139 to form a high-pressure chamber (not shown). A suction tube (not shown) is fixed to the sealed container 101 and connected to a low-pressure side (not shown) of a refrigeration cycle. The suction tube introduces the refrigerant gas from the refrigeration cycle into the sealed container 101. A suction muffler 142 is sandwiched between the valve plate 139 and the cylinder head 140.

Film

The crank shaft 108 is constituted by a base member 150 and a film coating the surface of the base member 150. The base member 150 is formed by an iron-based material, such as gray cast iron. The film has hardness equal to or more than the hardness of the main bearing 111 and the hardness of the eccentric bearing 119. One example of the film is an oxide film 160. For example, the gray cast iron as the base member 150 is oxidized by using known oxidizing gas, such as carbon dioxide gas, and a known oxidation facility at several hundreds of degrees Celsius (for example, 400 to 800° C.). With this, the oxide film 160 can be formed on the surface of the base member 150.

Figure 2:
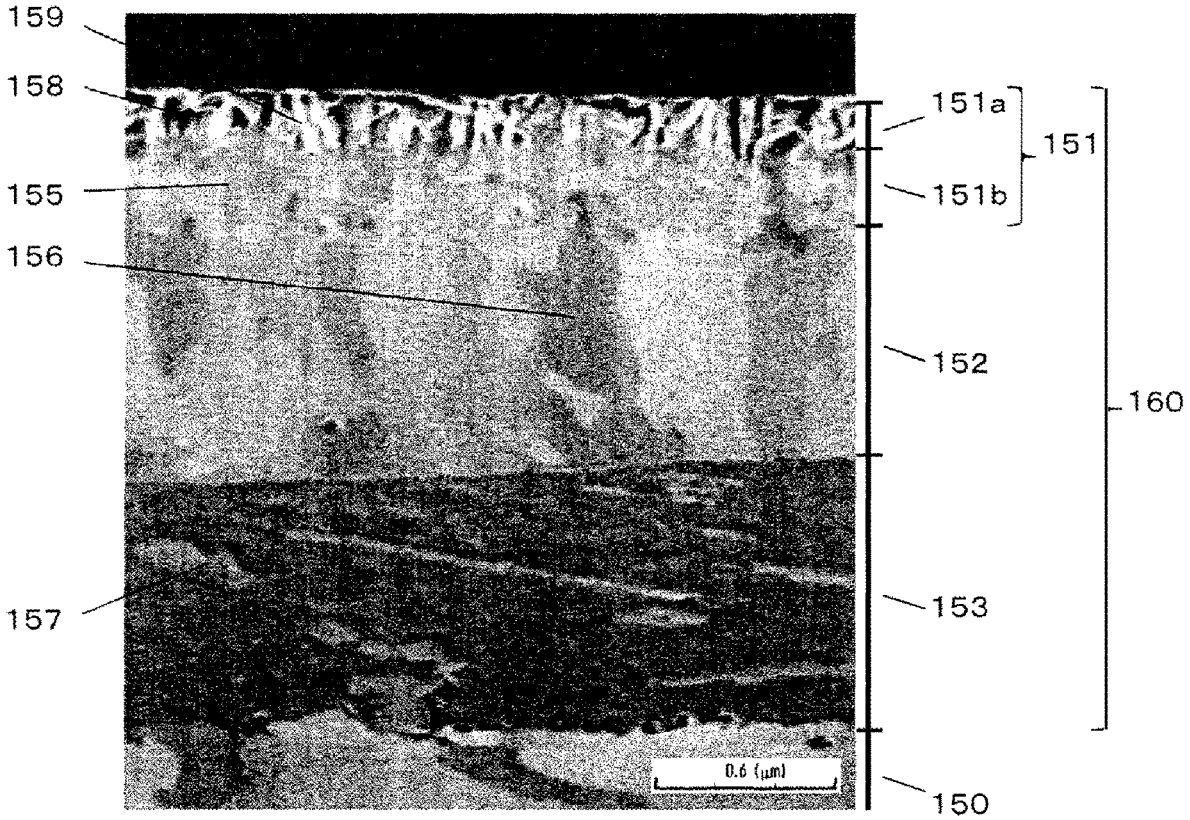
FIG. 2 is a SIM image showing one example of an observation result of an oxide film of FIG. 1 by a SIM (scanning ion microscope).

As shown in FIG. 2, a dimension (film thickness) of the oxide film 160 in the vertical direction is about 3 μm. The oxide film 160 includes a first portion 151, a second portion 152, and a third portion 153, and these portions are laminated in this order from the surface toward the base member 150. In FIG. 2, a protective film (resin film) for protecting an observation sample is formed on the first portion 151. A direction parallel to the surface of the oxide film 160 is referred to as a lateral direction, and a direction perpendicular to the surface of the oxide film 160 is referred to as a vertical direction.

The first portion 151 constitutes the surface of the oxide film 160 and is formed on the second portion 152. The first portion 151 is formed by a structure of fine crystals. As a result of EDS (energy dispersive X-ray spectrometry) and EELS (electron ray energy loss spectrometry), a component contained most in the first portion 151 is diiron trioxide ($Fe_2O_3$), and the first portion 151 also contains a silicon (Si) compound. The first portion 151 includes two portions (a first-a portion 151*a* and a first-b portion 151*b*) which are different in crystal density from each other.

The first-a portion 151*a* is formed on the first-b portion 151*b* and constitutes the surface of the oxide film 160. The crystal density of the first-a portion 151*a* is lower than the crystal density of the first-b portion 151*b*. The first-a portion 151*a* contains gap portions 158 (black portions in FIG. 2) and acicular structures 159. The acicular structures 159 are vertically long. For example, a minor-axis length of the acicular structure 159 in the lateral direction is 100 nm or less, and a ratio (aspect ratio) obtained by dividing the length in the vertical direction by the length in the lateral direction is 1 or more and 10 or less.

The first-b portion 151*b* is a structure formed by spreading fine crystals 155 having a particle diameter of 100 nm or less. Although the gap portions 158 and the acicular structures 159 are observed in the first-a portion 151*a*, they are hardly observed in the first-b portion 151*b*.

The second portion 152 is formed on the third portion 153 and contains a large number of vertically long columnar structures 156 lined up in the same direction. For example, the length of the columnar structure 156 in the vertical direction is about 100 nm or more and 1 μm or less, and the length of the columnar structure 156 in the lateral direction is about 100 nm or more and 150 nm or less. The aspect ratio of the columnar structure 156 is about 3 or more and 10 or less. According to the analytical results of the EDS and the EELS, a component contained most in the second portion 152 is triiron tetroxide ($Fe_3O_4$), and the second portion 152 also contains a silicon (Si) compound.

The third portion 153 is formed on the base member 150 and contains laterally long lamellar structures 157. For example, the length of the lamellar structure 157 in the vertical direction is several tens of nanometers or less, and the length of the lamellar structure 157 in the lateral direction is about several hundreds of nanometers. The aspect ratio of the lamellar structure 157 is 0.01 or more and 0.1 or less, i.e., the lamellar structure 157 is long in the lateral direction. According to the analytical results of the EDS and the EELS, a component contained most in the third portion 153 is triiron tetroxide ($Fe_3O_4$), and the third portion 153 also contains a silicon (Si) compound and a silicon (Si) solid solution component.

In FIG. 2, the oxide film 160 is constituted by the first portion 151, the second portion 152, and the third portion 153, and the first, second, and third portions 151, 152, and 153 are laminated in this order. However, the configuration of the oxide film 160 and the order of the lamination are not limited to these.

For example, the oxide film 160 may be constituted by a single layer that is the first portion 151. The oxide film 160 may be constituted by two layers that are the first portion 151 and the second portion 152 such that the first portion 151 forms the surface of the oxide film 160. The oxide film 160 may be constituted by two layers that are the first portion 151 and the third portion 153 such that the first portion 151 forms the surface of the oxide film 160.

The oxide film 160 may contain a composition other than the first portion 151, the second portion 152, and the third portion 153. The oxide film 160 may be constituted by four layers that are the first portion 151, the second portion 152, the first portion 151, and the third portion 153 such that the first portion 151 forms the surface of the oxide film 160.

The configuration of the oxide film 160 and the order of the lamination are easily realized by adjusting conditions. A typical condition is a method of producing (forming) the oxide film 160. A known method of oxidizing an iron-based material can be suitably used as the method of producing the oxide film 160. However, the present embodiment is not limited to this. Conditions in the producing method are suitably set in accordance with conditions, such as the type of the iron-based material forming the base member 150, the surface state (for example, polishing finish) of the base member 150, and a physical property of the desired oxide film 160.

Hardness

Figure 3:
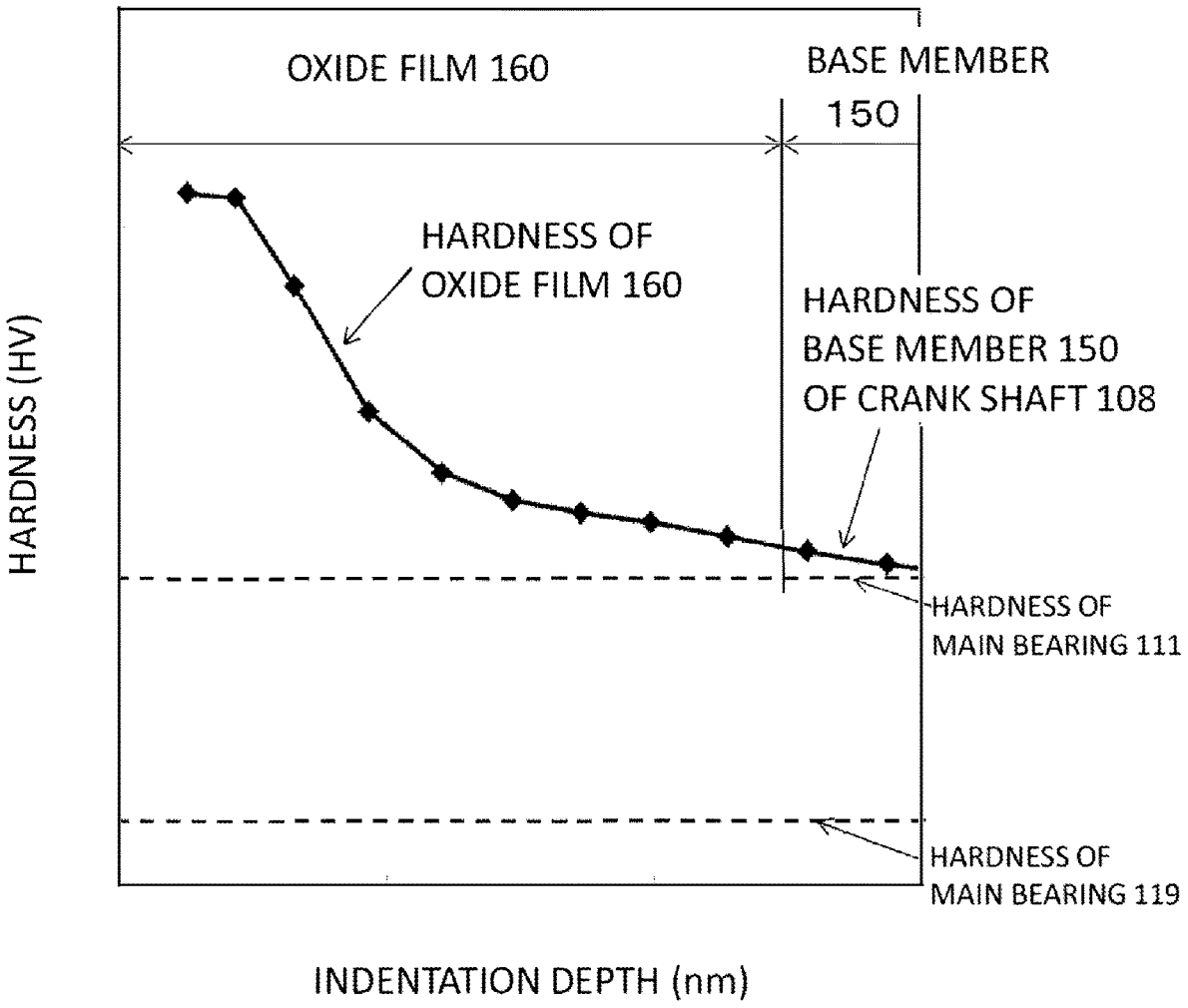
FIG. 3 is a graph showing hardness of a crank shaft of FIG. 1 in a depth direction, hardness of a main bearing of FIG. 1 in the depth direction, and hardness of an eccentric bearing of FIG. 1 in the depth direction.

FIG. 3 is a graph showing the hardness of the crank shaft 108 in the depth direction, the hardness of the main bearing 111 in the depth direction, and the hardness of the eccentric bearing 119 in the depth direction. It should be noted that the hardness is shown by Vickers hardness. A nano indentation apparatus (triboindenter) produced by Scienta Omicron, Inc. is used for the measurement of the hardness.

Performed in the measurement of the hardness of the crank shaft 108 is a step in which an indenter is pressed against the surface of the crank shaft 108 to apply a load to the surface for a certain period of time. Then, in the next step, the application of the load is stopped once, and the indenter is again pressed against the surface of the crank shaft 108 to apply a load higher than the previous load to the surface for a certain period of time. Such steps in which the applied loads are stepwisely increased are repeatedly performed 15 times. Further, the loads in the respective steps are set such that the highest load becomes 1 N. After each step, the hardness and depth of the oxide film 160 and the hardness and depth of the base member 150 in the crank shaft 108 are measured.

In the measurement of the hardness of the main bearing 111 and the hardness of the eccentric shaft 110, a part of the main bearing 111 and a part of the eccentric shaft 110 are cut by a fine cutter. The hardness of this part of the main bearing 111 and the hardness of this part of the eccentric shaft 110 are measured by applying a load of 0.5 kgf to the inner peripheral surface of the main bearing 111 and an inner peripheral surface of the eccentric shaft 110 by using the indenter.

As a result, the hardness of the main shaft 109 of the crank shaft 108 is equal to or more than the hardness of the main bearing 111 that is an opponent sliding member, and the hardness of the eccentric shaft 110 of the crank shaft 108 is equal to or more than the hardness of the eccentric bearing 119 that is the opponent sliding member.

The hardness is one of mechanical properties of the surface of an object, such as a substance or a material, or the vicinity of the surface of the object. The hardness denotes the unlikelihood of the deformation of the object and the unlikelihood of the damage of the object when external force is applied to the object. Regarding the hardness, there are various measurement means (definitions) and their corresponding values (measures of the hardness). Therefore, the measurement means corresponding to a measurement target may be used.

For example, when the measurement target is a metal or a nonferrous metal, an indentation hardness test method (such as the above-described nano indentation method, the Vickers hardness method, or the Rockwell hardness method) is used for the measurement.

Further, for the measurement targets, such as resin films and phosphate films, which are difficult to be measured by the indentation hardness test method, an abrasion test such as a ring-on-disk test is used. In one example of this measurement method, a test piece is prepared by forming a film on the surface of a disk. With the test piece immersed in oil, the test piece is rotated at a rotational speed of hills for an hour while applying a load of 1000 N to the film by a ring. With this, the ring slides on the film. The state of the sliding surface of the film and the state of the sliding surface of the surface of the ring are observed. As a result, it may be determined that one of the ring and the film which one is larger in abrasion loss has lower hardness.

Shape

Figure 4:
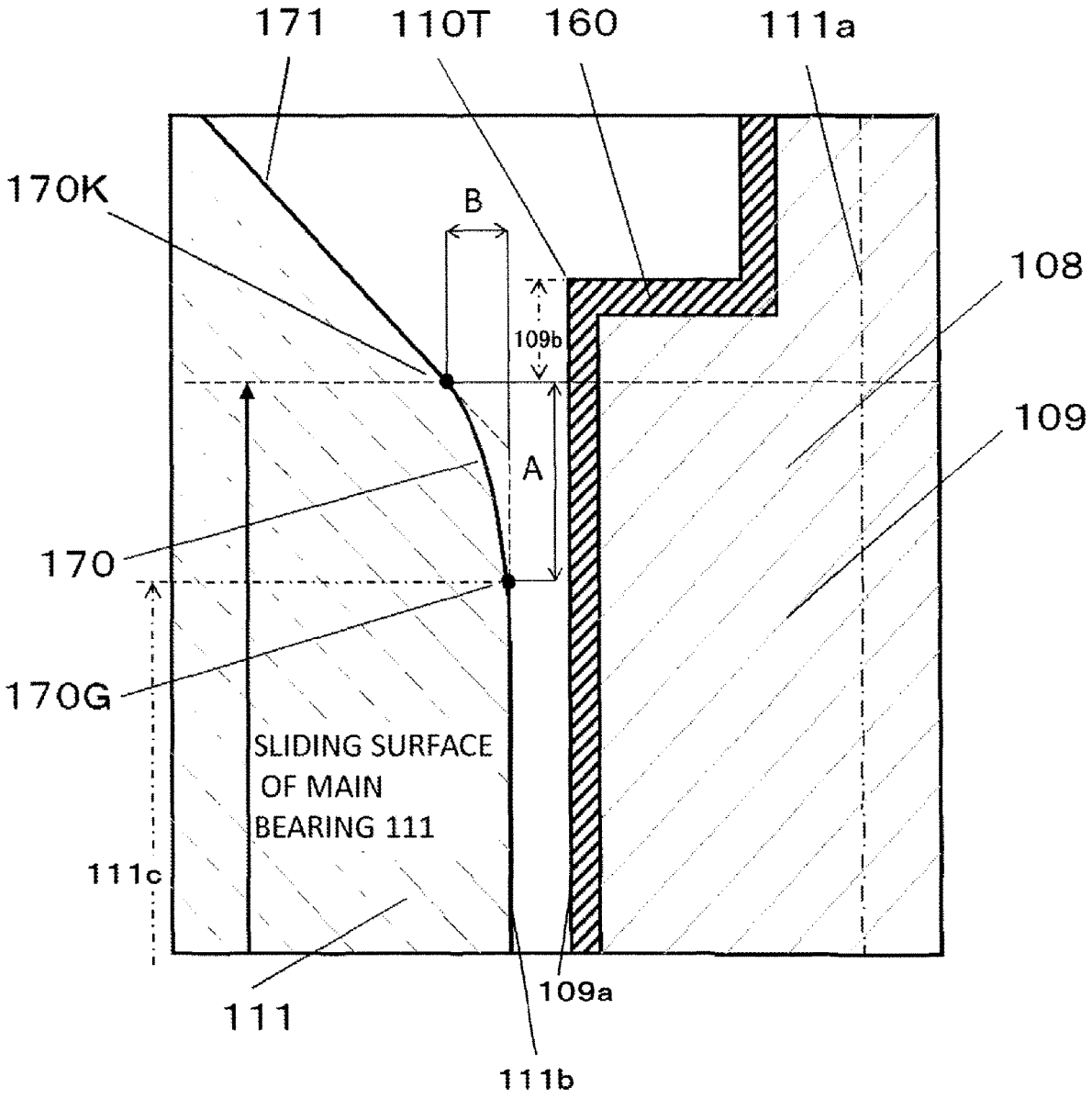
FIG. 4 is an enlarged view showing a part E of FIG. 1.

As shown in FIG. 4, chamfered surfaces 171 and a sliding surface (first sliding surface 111*b*) are provided on the inner peripheral surface of the main bearing 111, and bell mouths 170 are provided on the first sliding surface 111*b*. The chamfered surfaces 171, the first sliding surface 111*b*, and the bell mouths 170 are formed over the entire periphery in the circumferential direction about a center axis 111*a* of the main bearing 111. In a direction (center axis direction) parallel to the center axis 111*a* of the main bearing 111, the chamfered surfaces 171 are formed at both respective ends of the main bearing 111, and the bell mouths 170 are formed at both respective ends of the first sliding surface 111*b*. FIG. 4 shows one end of the main bearing 111. Since the other end of the main bearing 11 is the same as the one end, explanations and drawings thereof are omitted.

The chamfered surface 171 is arranged closer to the end of the main bearing 111 than the first sliding surface 111*b* in the center axis direction of the main bearing 111 and is formed by an inclined surface. An inner diameter of the inclined surface increases as it approaches the end of the main bearing 111, and the inclined surface is inclined at a constant angle. Burrs of the main bearing 111 are removed by the chamfered surface 171.

The first sliding surface 111*b* includes the bell mouths 170 and a first straight portion 111*c*. The first straight portion 111*c* is parallel to the center axis 111*a* of the main bearing 111, and the inner diameter of the first straight portion 111*c* is constant in the center axis direction of the main bearing 111.

The bell mouth 170 is a curved-surface portion having an inner diameter that continuously increases in a curved shape as it approaches the end of the main bearing 111 in the center axis direction. The inner diameter of the bell mouth 170 starts increasing from the first straight portion 111*c*. The bell mouth 170 is provided at an end portion of the first sliding surface 111*b* so as to be adjacent to the chamfered surface 171. For example, the bell mouth 170 is formed on the main bearing 111 after the chamfered surface 171 is formed. In the center axis direction of the main bearing 111, one end (first end) 170K coincides with an end of the first sliding surface 111*b* and is connected to an end of the chamfered surface 171. The other end (second end) 170G opposite to the first end 170K is connected to an end of the first straight portion 111*c*.

In a section passing through the center axis 111*a* of the main bearing 111, the bell mouth 170 is formed in a curved shape having an inner diameter that continuously increases from the second end 170G toward the first end 170K. The curved shape is a shape approximated by a logarithmic function in a region from the first end 170K to the second end 170G. The bell mouth 170 has such a shape that: a curvature radius of the bell mouth 170 decreases from the second end 170G toward the first end 170K; and the curvature radius at the second end 170G is larger than the curvature radius at the first end 170K.

A sliding surface (second sliding surface 109*a*) and a surface (extended surface 109*b*) extended from the second sliding surface 109*a* are provided on the outer peripheral surface of the main shaft 109. The second sliding surface 109*a* and the extended surface 109*b* are parallel to the center axis of the main shaft 109 and are the same in diameter as each other. A corner 110T of the extended surface 109*b* is not opposed to the first sliding surface 111*b* but is opposed to the chamfered surface 171 located closer to the end of the main bearing 111 than the bell mouth 170. With this, even when the main shaft 109 inclines in the main bearing 111, the corner 110T does not directly contact the inner peripheral surface of the main bearing 111. It should be noted that when the extended surface 109*b* is not provided at the main shaft 109, the corner 110T of the main shaft 109 is provided at an end of the second sliding surface 109*a* in some cases, instead of an end of the extended surface 109*b*.

A length of the bell mouth 170 in the center axis direction is shown by A (hereinafter referred to as a bell mouth width A), and a length of the bell mouth 170 in a direction perpendicular to the center axis direction is shown by B (hereinafter referred to as a bell mouth depth B). In the present embodiment, the bell mouth 170 having the bell mouth width A of 3 mm and the bell mouth depth B of 6 μm is formed. A value (ratio B/A) obtained by dividing the bell mouth depth B by the bell mouth length A is 2/1000.

Operations of Refrigerant Compressor

Electric power supplied from a commercial power supply (not shown) is supplied to the electric component 106 through an external inverter drive circuit (not shown). With this, the electric component 106 is inverter-driven at a plurality of operation frequencies, and the rotor 105 of the electric component 106 rotates the crank shaft 108. The eccentric motion of the eccentric shaft 110 of the crank shaft 108 is converted into the linear motion of the piston 132 by the connecting rod 117 and the piston pin 115, and the piston 132 reciprocates in the compression chamber 134 of the cylinder bore 113. Therefore, the refrigerant gas introduced through the suction tube into the sealed container 101 is sucked in the compression chamber 134 from the suction muffler 142. Then, the refrigerant gas is compressed in the compression chamber 134 and ejected from the sealed container 101.

In accordance with the rotation of the crank shaft 108, the lubricating oil 103 is supplied from the oil supply pump 120 to the sliding surfaces to lubricate the sliding surfaces. In addition, the lubricating oil 103 forms a seal between the piston 132 and the cylinder bore 113 to seal the compression chamber 134.

Performance of Refrigerant Compressor

Figure 5A:
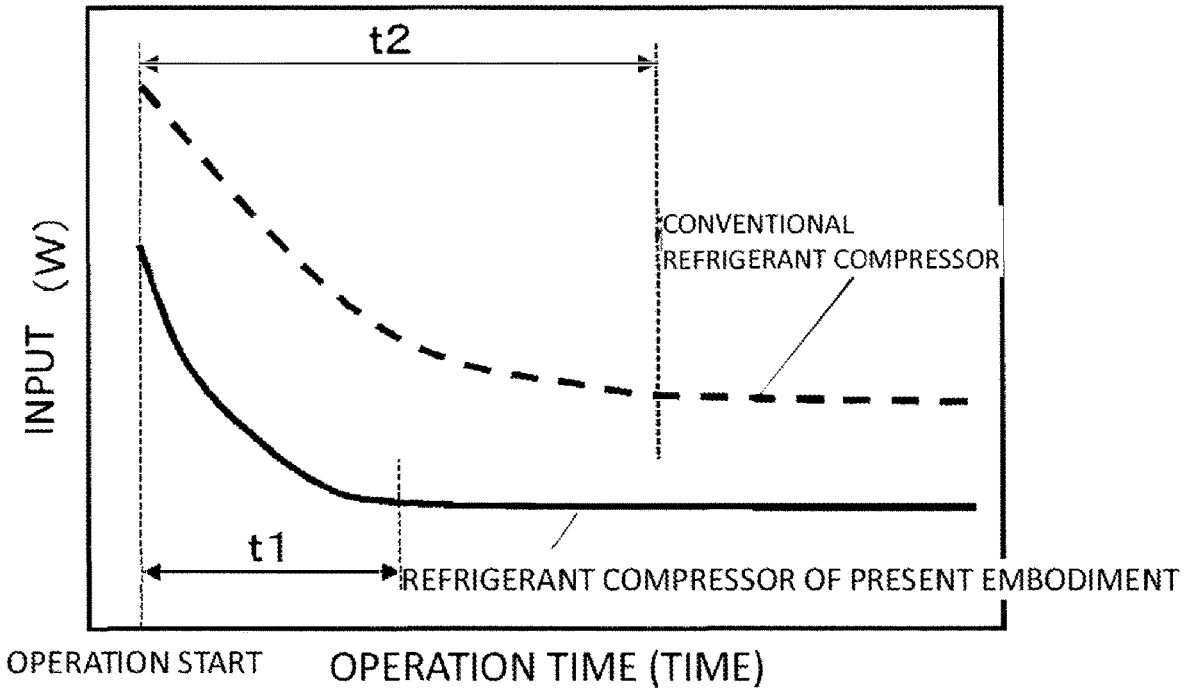
FIG. 5A is a graph showing a curved line of a time-series change of an input to the refrigerant compressor of FIG. 1.
Figure 5B:
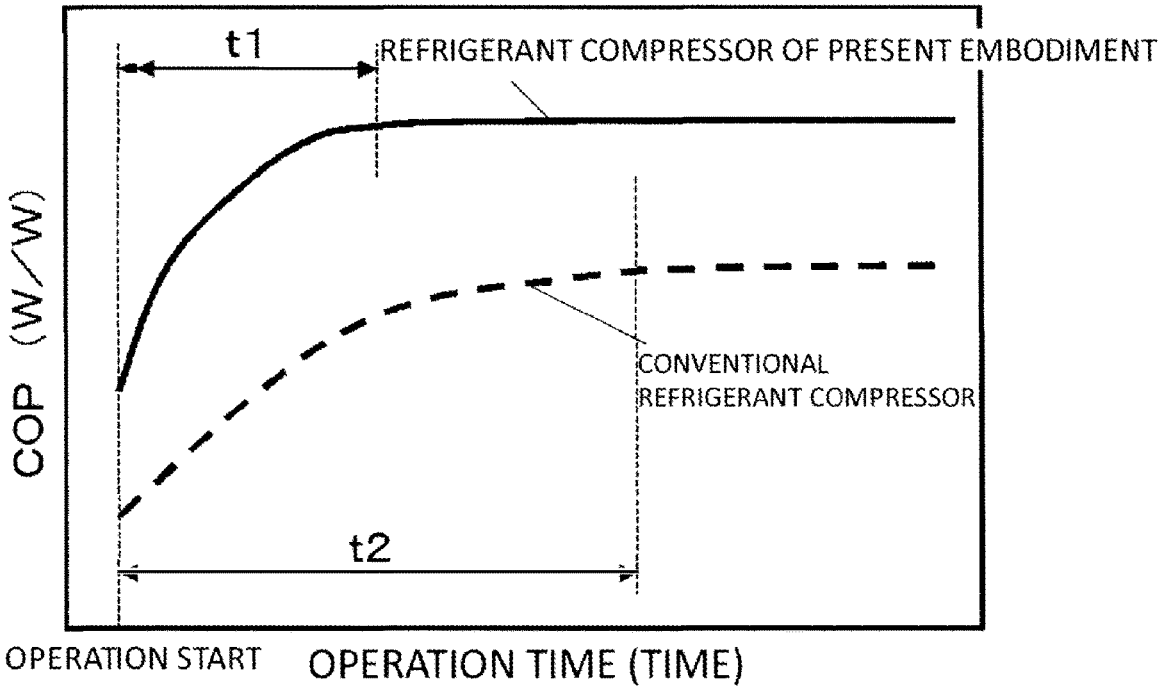
FIG. 5B is a graph showing a curved line of a time-series change of a COP of the refrigerant compressor of FIG. 1.

FIG. 5A shows a time-series change of the input to the refrigerant compressor, and FIG. 5B shows a time-series change of a COP (Coefficient of Performance) of the refrigerant compressor. The COP is a coefficient used as an index of energy consumption efficiency of a refrigerant compressor of a freezer/refrigerator or the like. The COP is a value obtained by dividing a freezing capacity (W) by an input (W). Herein, the input and the COP when the refrigerant compressor performs the low-speed operation at the operation frequency of 17 Hz are obtained. A conventional refrigerant compressor does not include a bell mouth.

As shown in FIG. 5A, in both the refrigerant compressor of the present embodiment and the conventional refrigerant compressor, the input immediately after the operation start (hereinafter referred to as an "initial input") is the highest. Then, the input gradually decreases with the lapse of the operating time and finally becomes a constant value (hereinafter referred to as a "steady input") which changes little. Further, the initial input to the refrigerant compressor of the present embodiment is lower than that to the conventional refrigerant compressor, and a time (transition time) it takes to change from the initial input to the steady input in the refrigerant compressor of the present embodiment is shorter than that in the conventional refrigerant compressor. A transition time t1 of the refrigerant compressor of the present embodiment is about ½ of a transition time t2 of the conventional refrigerant compressor. Thus, as shown in FIG. 5B, the COP of the refrigerant compressor of the present embodiment is stabilized more quickly and is improved more than that of the conventional refrigerant compressor.

Actions and Effects

Figure 6:
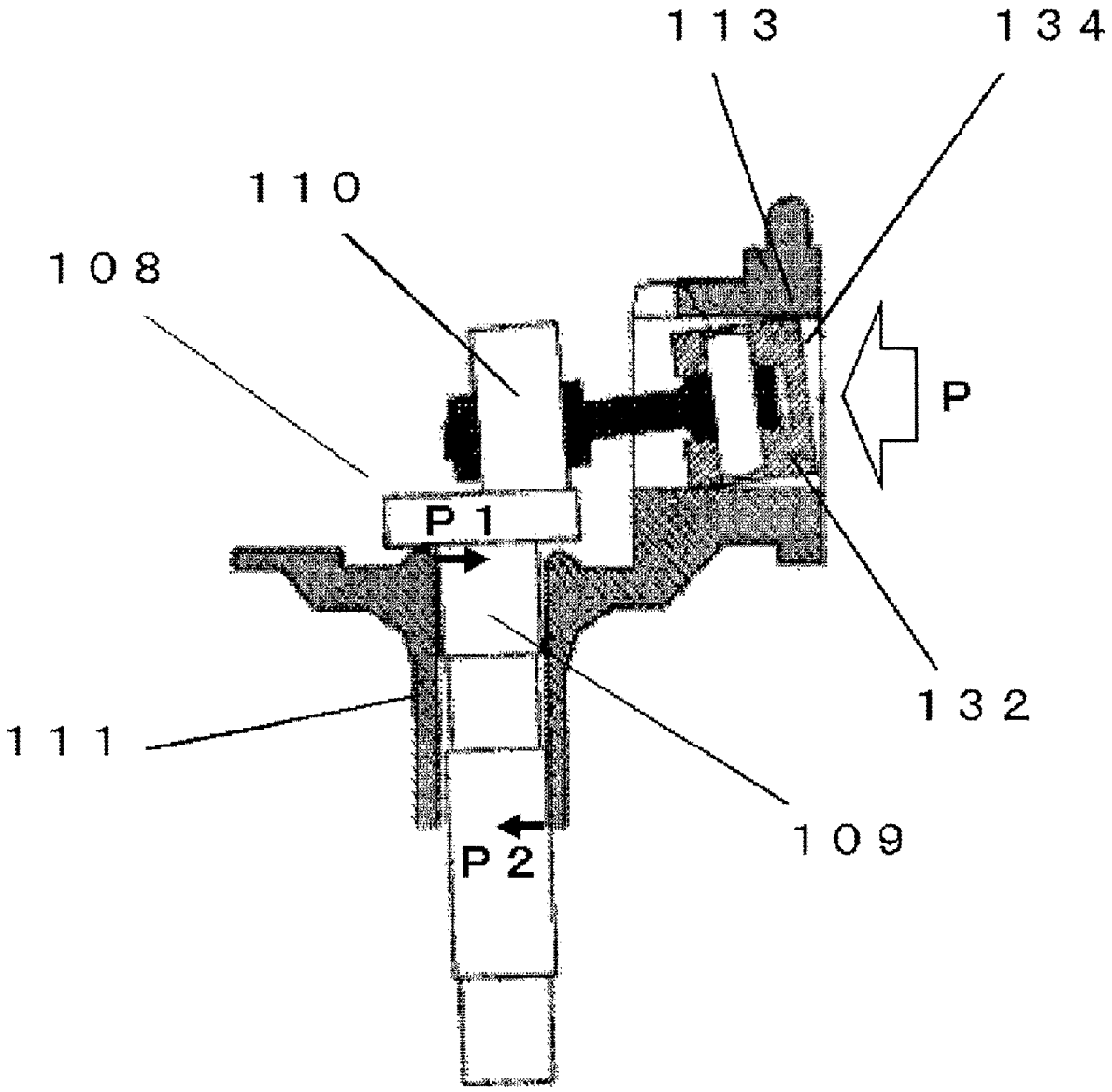
FIG. 6 is a diagram showing a load in the refrigerant compressor of FIG. 1.

This will be considered as below with reference to FIG. 6. FIG. 6 is an action diagram of a compressive load in the refrigerant compressor. The refrigerant compressor according to the present embodiment is a reciprocating type, and pressure in the sealed container 101 is lower than a compressive load P in the compression chamber 134. Typically, with the compressive load P acting on the eccentric shaft 110, the main shaft 109 connected to the eccentric shaft 110 is supported by the single main bearing 111 in a cantilever manner.

Therefore, as described in a literature (Collection of Papers of Annual Meeting of The Japan Society of Mechanical Engineers, Vol. 5-1 (2005) page 143) written by Ito and others, the crank shaft 108 including the main shaft 109 and the eccentric shaft 110 whirls in an inclined state in the main bearing 111 by the influence of the compressive load P. A component P1 of the compressive load P acts on the sliding surface of the main shaft 109 and the opposing sliding surface of the upper end portion of the main bearing 111. Further, a component P2 of the compressive load P acts on the sliding surface of the main shaft 109 and the opposing sliding surface of the lower end portion of the main bearing 111. Thus, so-called one-side hitting occurs.

Even after a typical final polishing step, a large number of minute projections exist on both the sliding surface of the main shaft 109 and the sliding surface of the main bearing 111. According to the conventional refrigerant compressor, when the main shaft inclines in the main bearing, local contact occurs, and surface pressure becomes high. Further, in the lower-speed operation, an oil film thickness h between the sliding surface of the main shaft and the sliding surface of the main bearing decreases, or an air film breaks, and as a result, the solid contact by the projections frequently occurs. In addition, when the sliding surface of the main shaft is formed by the oxide film having high abrasion resistance, minute projections located on the surface of the main shaft and having high hardness hardly abrade, and therefore, the contact between the main shaft and the main bearing hardly becomes smooth. Therefore, the time of occurrence of the solid contact increases. Thus, the initial input to the refrigerant compressor becomes high, and the transition time from the initial input to the steady input increases.

On the other hand, in the refrigerant compressor according to the present embodiment, the bell mouths 170 are formed at the upper and lower end portions of the first sliding surface 111*b*. With this, even when the main shaft 109 inclines in the main bearing 111, the local contact between the main shaft 109 and the main bearing 111 is reduced, and the concentration of the stress is eased. With this, the formation of the oil film between the main shaft 109 and the main bearing 111 is promoted, so that the initial input to the refrigerant compressor can be made low, and the transition time from the initial input to the steady input can be shortened. Further, since the film having high abrasion resistance is formed on the surface of the main shaft 109, the durability can also be secured.

To be specific, according to the conventional refrigerant compressor, when the main shaft 109 inclines, the sliding surface of the main shaft 109 contacts the corner of the end portion of the first sliding surface 111*b* (when the end portion of the sliding surface is chamfered, the sliding surface of the main shaft 109 contacts the corner of the boundary between the chamfered portion and the other portion). Surface pressure between the main shaft 109 and the main bearing 111 increases by the contact between the corner and the sliding surface. With this, the oil film becomes thin or is cut, and therefore, the solid contact by the projections frequently occurs.

On the other hand, according to the refrigerant compressor of the present embodiment, the bell mouth 170 having a curved shape is formed at the end portion of the first sliding surface 111*b*. With this, even when the main shaft 109 contacts the bell mouth 170, a contact area between the main shaft 109 and the bell mouth 170 is larger than that in the conventional refrigerant compressor, so that the concentration of the contact stress is eased, and the surface pressure between the main shaft 109 and the bell mouth 170 is significantly reduced. Therefore, the oil film is easily formed between the main shaft 109 and the bell mouth 170, and as a result, the initial input can be made low, and the transition time from the initial input to the steady input can be shortened.

The corner 110T of the main shaft 109 is opposed to a position closer to the end of the main bearing 111 than the bell mouth 170. With this, even when the main shaft 109 inclines in the main bearing 111, the contact between the corner 110T and the first sliding surface 111*b* can be avoided, and a substantially line contact state or a substantially surface contact state can be kept between the main shaft 109 and the main bearing 111. Therefore, the decrease in thickness of the oil film and the break of the oil film are suppressed between the main shaft 109 and the bell mouth 170, so that it is possible to provide a highly-efficient refrigerant compressor which secures long-term reliability and is low in input from the initial stage of the operation.

The bell mouth 170 has a shape approximated by a logarithmic function in a region from the first end 170K to the second end 170G. Further, the bell mouth 170 is formed such that the curvature radius at the second end 170G is larger than the curvature radius at the first end 170K. Therefore, even when the main shaft 109 inclines in the main bearing 111, the main shaft 109 contacts the second end 170G having the larger curvature radius, so that the contact area between the main shaft 109 and the main bearing 111 can be made large. On this account, an increase in the surface pressure between the main shaft 109 and the main bearing 111 is suppressed, and the decrease in thickness of the oil film and the break of the oil film are suppressed between the main shaft 109 and the main bearing 111, so that it is possible to provide the highly-efficient refrigerant compressor which secures long-term reliability and is low in input from the initial stage of the operation.

The oxide film 160 includes the first portion 151, the second portion 152, and the third portion 153. Therefore, by the oxide film 160, the main shaft 109 becomes hard and obtains improved abrasion resistance. In addition, the attacking property (opponent attacking property) of the main shaft 109 with respect to the main bearing 111 is reduced, and the contact property of the main shaft 109 at the initial stage of the sliding operation also improves. Therefore, in combination with the effect obtained by providing the bell mouth 170 at the main bearing 111, the highly-efficient operation in which the input to the refrigerant compressor is low from the initial stage of the operation is realized.

Details of the increase in the abrasion resistance of the oxide film 160, the reduction in the opponent attacking property of the oxide film 160, and the improvement of the contact property of the oxide film 160 at the initial stage of the sliding operation are described in Japanese Patent Application Nos. 2016-003910 and 2016-003909 filed by the present applicant. One of the reasons for these may be as below.

Since the oxide film 160 is an oxide of iron, the oxide film 160 is chemically more stable than the conventional phosphate film. Further, the film of the oxide of iron has higher hardness than the phosphate film. Therefore, by the formation of the oxide film 160 on the sliding surface, the generation, adhesion, and the like of the abrasion powder can be effectively prevented. As a result, the increase in the abrasion loss of the oxide film 160 itself can be effectively avoided, and the oxide film 160 exhibits high abrasion resistance.

In addition, the first portion 151 contains the silicon (Si) compound having higher hardness than the oxide of iron. Since the surface of the oxide film 160 is constituted by the first portion 151 containing the silicon (Si) compound, the oxide film 160 can exhibit higher abrasion resistance.

A component contained most in the first portion 151 constituting the surface of the oxide film 160 is diiron trioxide ($Fe_2O_3$). The crystal structure of diiron trioxide ($Fe_2O_3$) is rhombohedron, and the surface of the crystal structure of diiron trioxide ($Fe_2O_3$) is more flexible than the cubic crystal structure of triiron tetroxide ($Fe_3O_4$) located under the crystal structure of diiron trioxide ($Fe_2O_3$) and the crystal structures of a dense hexagonal crystal, face-centered cubic crystal, and body-centered tetragonal crystal of a nitriding film. Therefore, it is thought that the first portion 151 containing a large amount of diiron trioxide ($Fe_2O_3$) has more appropriate hardness, lower opponent attacking property, and better contact property at the initial stage of the sliding operation than a conventional gas nitriding film or a typical oxide film (triiron tetroxide ($Fe_3O_4$) film).

To be specific, the surface of the oxide film 160 constituting the surface of the main shaft 109 contains a large amount of diiron trioxide ($Fe_2O_3$) that is relatively hard, has the rhombohedral crystal structure, and is flexible. Therefore, the opponent attacking property is reduced, and the break of the oil film and the like are suppressed. Further, the contact property at the initial stage of the sliding operation improves. In addition, in combination with the effect obtained by providing the bell mouth 170 at the main bearing 111, the highly-efficient operation in which the input to the refrigerant compressor is low from the initial stage of the operation is realized.

Further, the second portion 152 and third portion 153 of the oxide film 160 contain the silicon (Si) compound and are located between the first portion 151 and the base member 150. Therefore, adhesive force of the oxide film 160 with respect to the base member 150 becomes strong. In addition, the amount of silicon contained in the third portion 153 is larger than that in the second portion 152. As above, the second portion 152 containing the silicon (Si) compound and the third portion 153 containing the silicon (Si) compound are laminated, and the third portion 153 containing a larger amount of silicon contacts the base member 150. With this, the adhesive force of the oxide film 160 can be further increased. As a result, the proof stress of the oxide film 160 with respect to the load at the time of the sliding operation improves, and the abrasion resistance of the oxide film 160 further improves. Even if the first portion 151 forming the surface of the oxide film 160 abrades, the second portion 152 and the third portion 153 remain, so that the oxide film 160 exhibits more excellent abrasion resistance.

Further, from a different point of view, it is thought that the increase in the abrasion resistance of the oxide film 160, the reduction in the opponent attacking property of the oxide film 160, and the improvement of the contact property of the oxide film 160 at the initial stage of the sliding operation are realized by the following reasons.

To be specific, the first portion 151 constituting the surface of the oxide film 160 contains the silicon (Si) compound, and in addition, has a dense fine crystal structure. Therefore, the oxide film 160 exhibits high abrasion resistance.

The first portion 151 has the fine crystal structure, and the slight minute gap portions 158 are formed in some places among the fine crystals, or minute depressions and projections are formed on the surface of the first portion 151. Therefore, the lubricating oil 103 is easily held on the surface (sliding surface) of the oxide film 160 by capillarity. To be specific, since there are the slight minute gap portions 158 and/or the minute depressions and projections, the lubricating oil 103 can be held on the sliding surfaces even under a severe sliding state, i.e., so-called "oil holding property" can be exhibited. As a result, the oil film is easily formed on the sliding surface.

Further, in the oxide film 160, the columnar structures 156 (second portion 152) and the lamellar structures 157 (third portion 153) exist under the first portion 151 and closer to the base member 150. These structures are lower in hardness and softer than the fine crystals 155 of the first portion 151. Therefore, during the sliding operation, the columnar structures 156 and the lamellar structures 157 serve as "cushioning materials." With this, by the pressure applied to the surface of the fine crystals 155 during the sliding operation, the fine crystals 155 behave so as to be compressed toward the base member 150. As a result, the opponent attacking property of the oxide film 160 is significantly lower than that of the other surface treated films, and therefore, the abrasion of the sliding surface of the opponent member is effectively suppressed.

It should be noted that the function of the "cushioning materials" is exhibited even if only one of the second portion 152 and the third portion 153 is provided. Therefore, the second portion 152 or the third portion 153 is only required to be located under the first portion 151. It is preferable that both the second portion 152 and the third portion 153 be located under the first portion 151.

The oxide film 160 has the low opponent attacking property and can exhibit the satisfactory "oil holding property." Therefore, an oil film forming ability of the shaft part including the oxide film 160 significantly improves. By the high oil film forming ability in combination with the effect obtained by providing the bell mouth 170 at the main bearing 111, the highly-efficient operation in which the input to the refrigerant compressor is low from the initial stage of the operation is realized.

MODIFIED EXAMPLE

According to the above configuration, the main shaft 109 is used as the shaft part, and the main bearing 111 is used as the bearing part. However, the shaft part and the bearing part are not limited to these. For example, the eccentric shaft 110 may be used as the shaft part, and the eccentric bearing 119 may be used as the bearing part. Therefore, a film having hardness equal to or more than the hardness of the opposing bearing part may be provided on the surface of the shaft part, i.e., on at least one of the surface of the main shaft 109 and the surface of the eccentric shaft 110. Further, the bell mouth 170 may be formed on the bearing part, i.e., on at least one of the main bearing 111 and the eccentric bearing 119. With this, the decrease in thickness of the oil film and the break of the oil film are suppressed also between the eccentric shaft 110 and the eccentric bearing 119, so that the initial input can be more effectively reduced, the transition time from the initial input to the steady input can be shortened, and the durability can also be secured.

In all the above configurations, the oxide film 160 is included on the surface of the shaft part. However, the film on the surface of the shaft part is not limited to this as long as the film has hardness equal to or more than the hardness of the bearing part. Examples of the film of the shaft part include a compound layer, a mechanical strength improved layer, and a layer formed by a coating method.

To be specific, when the base member 150 of the shaft part is an iron-based member, the film may be a film formed by a typical quenching method and a method of impregnating a surface layer with carbon, nitrogen, or the like. Further, the film may be a film formed by an oxidation treatment using steam and an oxidation treatment of performing immersion in a sodium hydroxide aqueous solution. Furthermore, the film may be a layer (mechanical strength improved layer) which is formed by cold working, work hardening, solute strengthening, precipitation strengthening, dispersion strengthening, and grain refining and in which a slip motion of a dislocation is suppressed, and the base member 150 is strengthened. Further, the film may be a layer formed by a coating method, such as plating, thermal spraying, PVD, or CVD.

In all the above configurations, the iron-based material is used as the material of the base member 150 of the shaft part. However, a material other than the iron-based material may be used as the material of the base member 150 as long as a film having hardness equal to or more than the hardness of the bearing part can be formed.

In all the above configurations, the bell mouths 170 are provided at both respective ends of the first sliding surface 111*b*. However, the bell mouth 170 may be provided at any one of both ends of the first sliding surface 111*b*.

In all the above configurations, the ratio B/A of the bell mouth 170 is 2/1000. However, the ratio B/A of the bell mouth 170 is not limited to this. The ratio B/A may be set in accordance with conditions, such as specifications, use environments, and the like of the refrigerant compressor. For example, the ratio B/A is set within a range of $1/5000$ or more and $1/50$ or less. If the ratio B/A is less than $1/5000$, the initial input may become high by the decrease in thickness of the oil film or the break of the oil film. In contrast, if the ratio B/A is more than $1/50$, the whirling of the crank shaft 108 may become excessive, and vibrations and noises may become large during the operation.

In all the above configurations, the bell mouth 170 is provided at the end portion of the first sliding surface 111*b*. However, the position of the bell mouth 170 is not limited to this. For example, the bell mouth 170 may also serve as the chamfered surface 171. In this case, since debarring is performed by the formation of the bell mouth 170, the chamfering step may be omitted.

In all the above configurations, the effects in the example in which the refrigerant compressor is driven by the low-speed operation (for example, at the operation frequency of 17 Hz) are explained. However, the operation of the refrigerant compressor is not limited to this. Even when the refrigerant compressor performs the operation at a commercial rotational frequency or the high-speed operation at a high rotational frequency, the performance and reliability of the refrigerant compressor can be improved as with when the refrigerant compressor performs the low-speed operation.

In all the above configurations, the refrigerant compressor is a reciprocating type. However, the refrigerant compressor may be the other type, such as a rotary type, a scroll type, or a vibration type. The configuration in which the shaft part includes the film having the hardness equal to or more than the hardness of the bearing part is not limited to the refrigerant compressor and may be used in an apparatus including sliding surfaces, and with this, the same effects can be obtained. Examples of the apparatus including the sliding surfaces include a pump and a motor.

Embodiment 2

Configuration of Refrigerant Compressor

Figure 7:
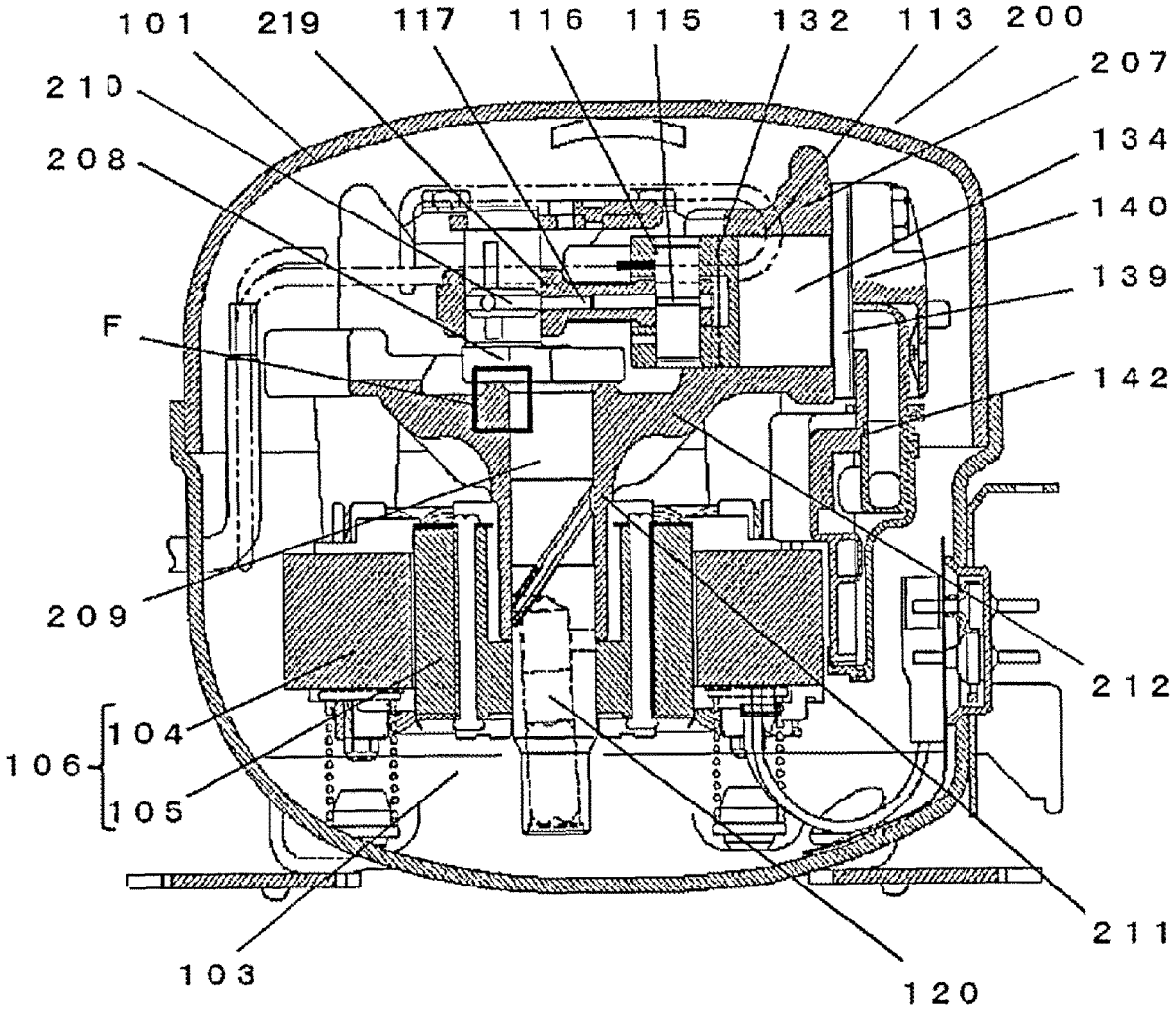
FIG. 7 is a sectional view schematically showing the refrigerant compressor according to Embodiment 2 of the present invention.

FIG. 7 is a schematic diagram showing the freezer according to Embodiment 2. Herein, the basic configuration of the freezer will be schematically explained. The freezer includes a refrigerant compressor 200. The refrigerant compressor 200 includes a reciprocating compression component 207 driven by the electric component 106.

The compression component 207 includes a crank shaft 208, a cylinder block 212, and the piston 132. Since the crank shaft 208, the cylinder block 212, and the piston 132 are the same as the crank shaft 108, the cylinder block 112, and the piston 132, respectively, explanations thereof are omitted.

The crank shaft 208 includes a main shaft 209 and an eccentric shaft 210. The main shaft 209 and the eccentric shaft 210 are the same as the main shaft 109 and the eccentric shaft 110, respectively, except that crownings 270 are provided at the main shaft 209 and the eccentric shaft 210. A main bearing 211 and an eccentric bearing 219 are the same as the main bearing 111 and the eccentric bearing 119, respectively, except that the bell mouths 170 are not provided at the main bearing 211 and the eccentric bearing 219.

Figure 8:
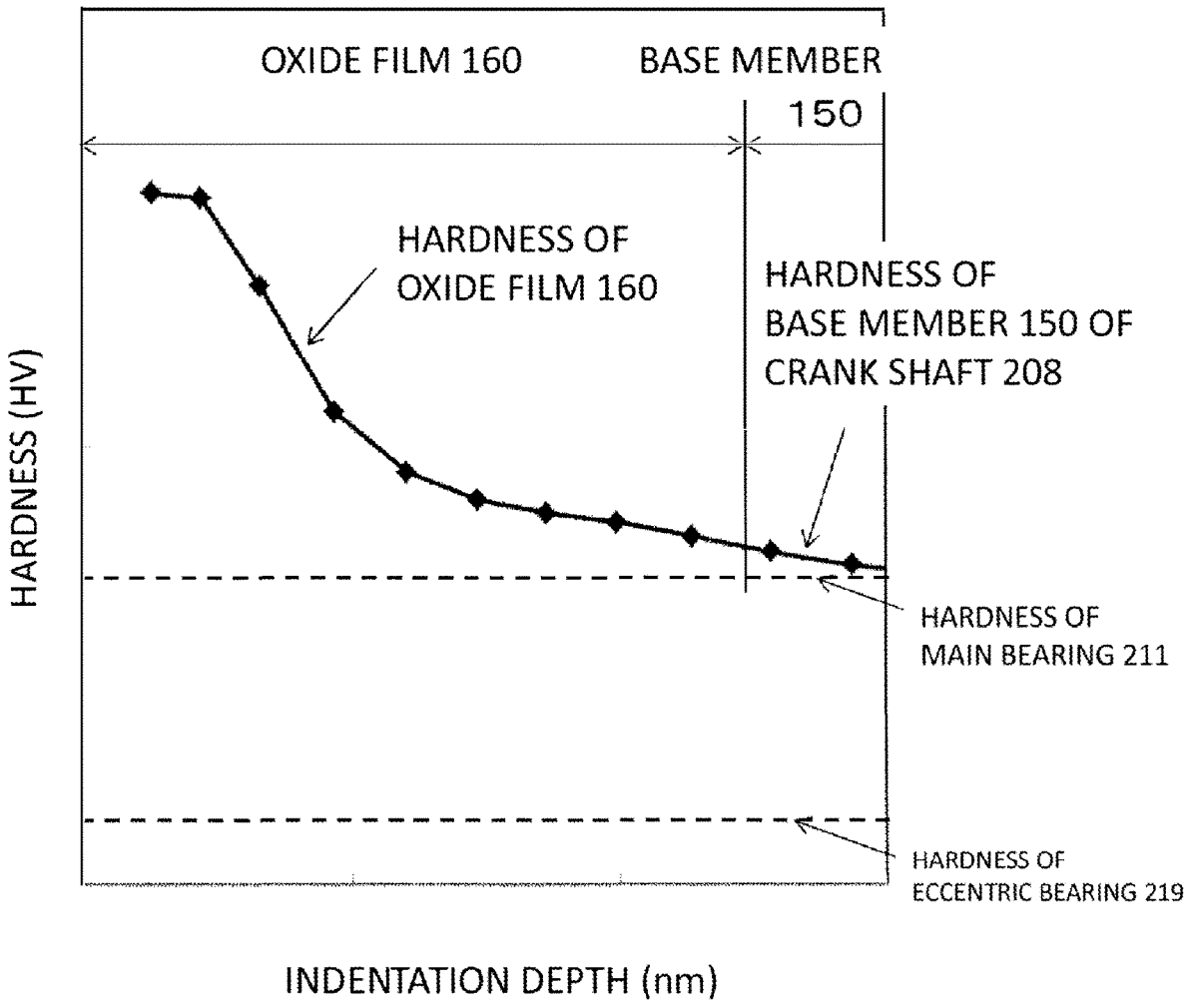
FIG. 8 is a graph showing the hardness of the crank shaft of FIG. 7 in the depth direction, the hardness of the main bearing of FIG. 7 in the depth direction, and the hardness of the eccentric bearing of FIG. 7 in the depth direction.

As shown in FIG. 8, the oxide film 160 is formed on the surface of the crank shaft 208. The oxide film 160 of the main shaft 209 of the crank shaft 208 is harder than the main bearing 211 that is an opponent sliding member. The oxide film 160 of the eccentric shaft 210 of the crank shaft 208 is harder than the eccentric bearing 219 that is an opponent sliding member.

Figure 9:
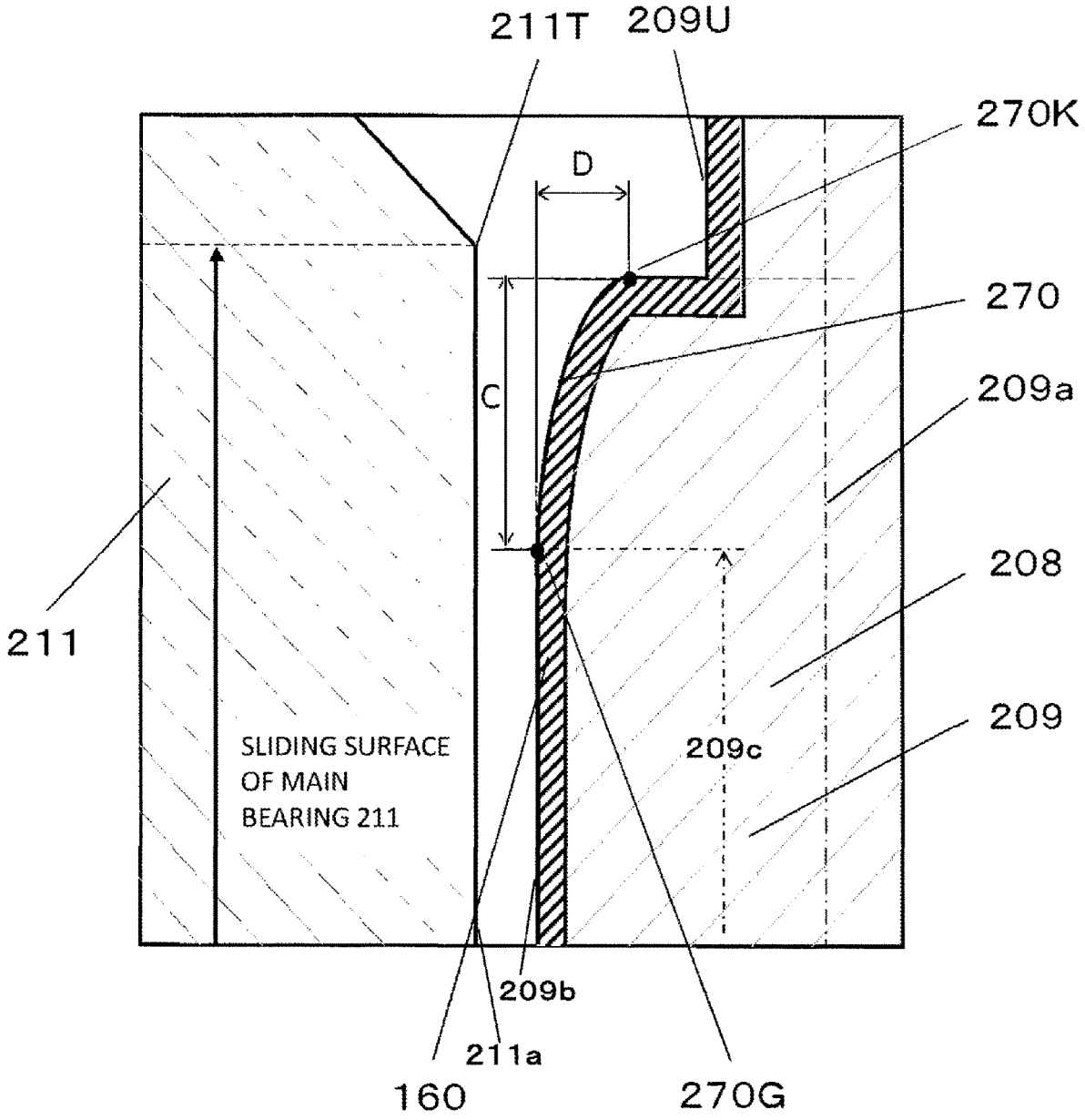
FIG. 9 is an enlarged view showing a part F of FIG. 7.

As shown in FIG. 9, a second sliding surface 209*b* and small-diameter portions 209U are provided on an outer peripheral surface of the main shaft 209, and the crownings 270 are provided on the second sliding surface 209*b*. The second sliding surface 209*b*, the small-diameter portions 209U, and the crownings 270 are formed over the entire periphery in the circumferential direction about a center axis 209*a* of the main shaft 209. The small-diameter portions 209U are formed at both respective ends of the main shaft 209, and the crownings 270 are formed at both respective ends of the second sliding surface 209*b*. FIG. 9 shows one end of the main shaft 209. Since the other end of the main shaft 209 is the same as the one end, explanations and drawings thereof are omitted.

The small-diameter portion 209U is provided closer to the end of the main shaft 209 than the second sliding surface 209*b*. The small-diameter portion 209U is a surface parallel to the center axis 209*a* of the main shaft 209. An outer diameter of the small-diameter portion 209U is smaller than the diameter of the second sliding surface 209*b*. The diameter of the small-diameter portion 209U is constant in a direction (center axis direction) parallel to the center axis 209*a* of the main shaft 209.

The second sliding surface 209*b* includes the crownings 270 and the other surface (second straight portion 209*c*). The second straight portion 209*c* is parallel to the center axis 209*a* of the main shaft 209, and the outer diameter of the second straight portion 209*c* is constant in the center axis direction of the main shaft 209.

The crowning 270 is a curved-surface portion having an outer diameter that continuously decreases in a curved shape as it approaches the end of the main shaft 209 in the center axis direction. The outer diameter of the crowning 270 starts decreasing from the second straight portion 209*c*. The crowning 270 is provided at an end portion of the second sliding surface 209*b* so as to be adjacent to the small-diameter portion 209U. The crowning 270 is opposed to a first sliding surface 211*a* of the main bearing 211. In a direction (center axis direction) parallel to the center axis 209*a* of the main shaft 209, one end (first end 270K) of the crowning 270 coincides with an end of the first sliding surface 211*a* and is connected to an end of the small-diameter portion 209U. The other end (second end 270G) opposite to the first end 270K is connected to an end of the second straight portion 209*c*.

In a section passing through the center axis 209*a* of the main shaft 209, the crowning 270 is formed in a curved shape having a diameter that continuously decreases from the second end 270G toward the first end 270K. The curved shape is a shape approximated by a logarithmic function in a region from the first end 270K to the second end 270G. The crowning 270 has such a shape that: a curvature radius of the crowning 270 decreases from the second end 270G toward the first end 270K; and the curvature radius at the second end 270G is larger than the curvature radius at the first end 270K.

The first sliding surface 211*a* and a chamfered surface are provided on an inner peripheral surface of the main bearing 211. The first sliding surface 211*a* is a surface parallel to the center axis of the main bearing 211. The chamfered surface is provided closer to an end of the main bearing 211 than the first sliding surface 211*a*. The chamfered surface is formed by an inclined surface having an inner diameter that increases as it approaches the end of the main bearing 211.

A corner 211T of the first sliding surface 211*a* of the main bearing 211 is arranged so as to be opposed to a position closer to the end of the main shaft 209 than the crowning 270 (in the example shown in FIG. 9, the corner 211T is opposed to the small-diameter portion 209U located at an outer side (upper side) of the first end 270K of the crowning 270). With this, even when the main shaft 209 inclines in the main bearing 211, the corner 211T can be prevented from directly contacting the crowning 270. It should be noted that the main bearing 211 may include an extended surface that is the same in diameter as the first sliding surface 211*a* and is extended from the first sliding surface 211*a*. In this case, the corner 211T of the main bearing 211 may be provided at an end of the extended surface, instead of an end of the first sliding surface 211*a*.

As shown in FIG. 9, a length of the crowning 270 in the center axis direction of the main shaft 209 is shown by C (hereinafter referred to as a crowning width C), and a length of the crowning 270 in a direction perpendicular to the center axis direction of the main shaft 209 is shown by D (hereinafter referred to as a crowning depth D). In the present embodiment, the crowning 270 having the crowning width C of 3 mm and the bell mouth depth D of 8 μm is formed. A value (ratio D/C) obtained by dividing the crowning depth D by the crowning length C is 8/3000.

Performance of Refrigerant Compressor

The input when the refrigerant compressor 200 performs the low-speed operation by inverter drive at the operation frequency of 17 Hz is obtained. The conventional refrigerant compressor does not include the bell mouth 170 at the main bearing 111.

As a result, in both the refrigerant compressor 200 and the conventional refrigerant compressor, the initial input is the highest. Then, the input gradually decreases with the lapse of the operating time and finally becomes the steady input. Further, the initial input to the refrigerant compressor 200 is lower than that to the conventional refrigerant compressor, and the transition time from the initial input to the steady input in the refrigerant compressor 200 is shorter than that in the conventional refrigerant compressor.

This will be considered as below. In the refrigerant compressor 200, even when the main shaft 209 inclines in the main bearing 211, local contact between the main shaft 209 and the main bearing 211 is eased by the crowning 270, and the decrease in thickness of the oil film and the break of the oil film are suppressed between the main shaft 209 and the main bearing 211. Therefore, the initial input can be made low, and the transition time from the initial input to the steady input can be shortened. Further, since the film having high abrasion resistance is formed on the surface of the shaft part, the durability can be secured.

Since the crowning 270 has a curved shape, the contact state between the crowning 270 and the main bearing 211 becomes a substantially surface contact state, not a local contact state. With this, the concentration of the contact stress is eased, and the surface pressure between the main shaft 209 and the main bearing 211 is significantly reduced, so that the decrease in thickness of the oil film and the break of the oil film are suppressed between the main shaft 209 and the main bearing 211. As a result, the initial input can be made low, and the transition time from the initial input to the steady input can be shortened.

Further, the corner 211T of the main bearing 211 is opposed to a position outside the range of the crowning 270. Therefore, even when the main shaft 209 inclines in the main bearing 211, the main shaft 209 does not directly contact the crowning 270. On this account, a substantially line contact state or a substantially surface contact state can be kept between the main shaft 209 and the main bearing 211, and the decrease in thickness of the oil film and the break of the oil film can be suppressed between the main shaft 209 and the main bearing 211. Thus, the highly-efficient refrigerant compressor which secures the long-term reliability and is low in input from the initial stage of the operation is realized.

The crowning 270 has a shape substantially approximated by a logarithmic function in a region from the first end 270K to the second end 270G. Further, the crowning 270 is formed such that the curvature radius at the second end 270G is larger than the curvature radius at the first end 270K. Therefore, even when the main shaft 209 inclines in the main bearing 211, the crowning 270 at the second end 270G contacts the main bearing 211, so that the contact area between the main shaft 209 and the main bearing 211 can be made large. On this account, an increase in the surface pressure between the main shaft 209 and the main bearing 211 can be more effectively suppressed, and the decrease in thickness of the oil film and the break of the oil film can be suppressed between the main shaft 209 and the main hearing 211. Thus, it is possible to provide the highly-efficient refrigerant compressor which secures the long-term reliability and is low in input from the initial stage of the operation.

MODIFIED EXAMPLE

In the above configurations, the crownings 270 are provided at both respective ends of the second sliding surface 209*b*. However, the crowning 270 may be provided at any one of both ends of the second sliding surface 209*b*.

In all the above configurations, the hard film and the crownings 270 may also be provided on the eccentric shaft 210 in addition to the main shaft 209. Or, the hard film and the crownings 270 may be provided on the eccentric shaft 210 instead of the main shaft 209. To be specific, the film and the crownings 270 may be provided at the shaft part (the main shaft 209, the eccentric shaft 210), the film having the hardness equal to or more than the hardness of the opposing bearing part (the main bearing 211, the eccentric bearing 219). With this, the highly-efficient refrigerant compressor can be provided.

In all the above configurations, the ratio D/C of the crowning 270 is set to 8/3000. However, the ratio D/C of the crowning 270 is not limited to this. The ratio D/C may be set within, for example, a range of 1/5000 or more and 1/50 or less in accordance with specifications and use environments of the refrigerant compressor 200. With this, the same effects as above are obtained. If the ratio D/C is less than 1/5000, the contact state between the shaft part and the bearing part is not so different from the contact state m the conventional refrigerant compressor, and the initial input of the refrigerant compressor may become high. In contrast, if the ratio DC is larger than 1/50, the whirling of the shaft part may become excessive, and vibrations and noises may become large.

In all the above configurations, the effects in the example in which the refrigerant compressor is driven by the low-speed operation (for example, at the operation frequency of 17 Hz) are explained. However, the operation of the refrigerant compressor is not limited to this. Even when the refrigerant compressor performs the operation at a commercial rotational frequency or the high-speed operation at a high rotational frequency, the performance and reliability of the refrigerant compressor can be improved as with when the refrigerant compressor performs the low-speed operation.

In all the above configurations, the refrigerant compressor is a reciprocating type. However, the refrigerant compressor may be the other type, such as a rotary type, a scroll type, or a vibration type. The configuration in which the shaft part includes the film having the hardness equal to or more than the hardness of the bearing part is not limited to the refrigerant compressor and may be used in an apparatus including sliding surfaces, and with this, the same effects can be obtained. Examples of the apparatus including the sliding surfaces include a pump and a motor.

Embodiment 3

Figure 10:
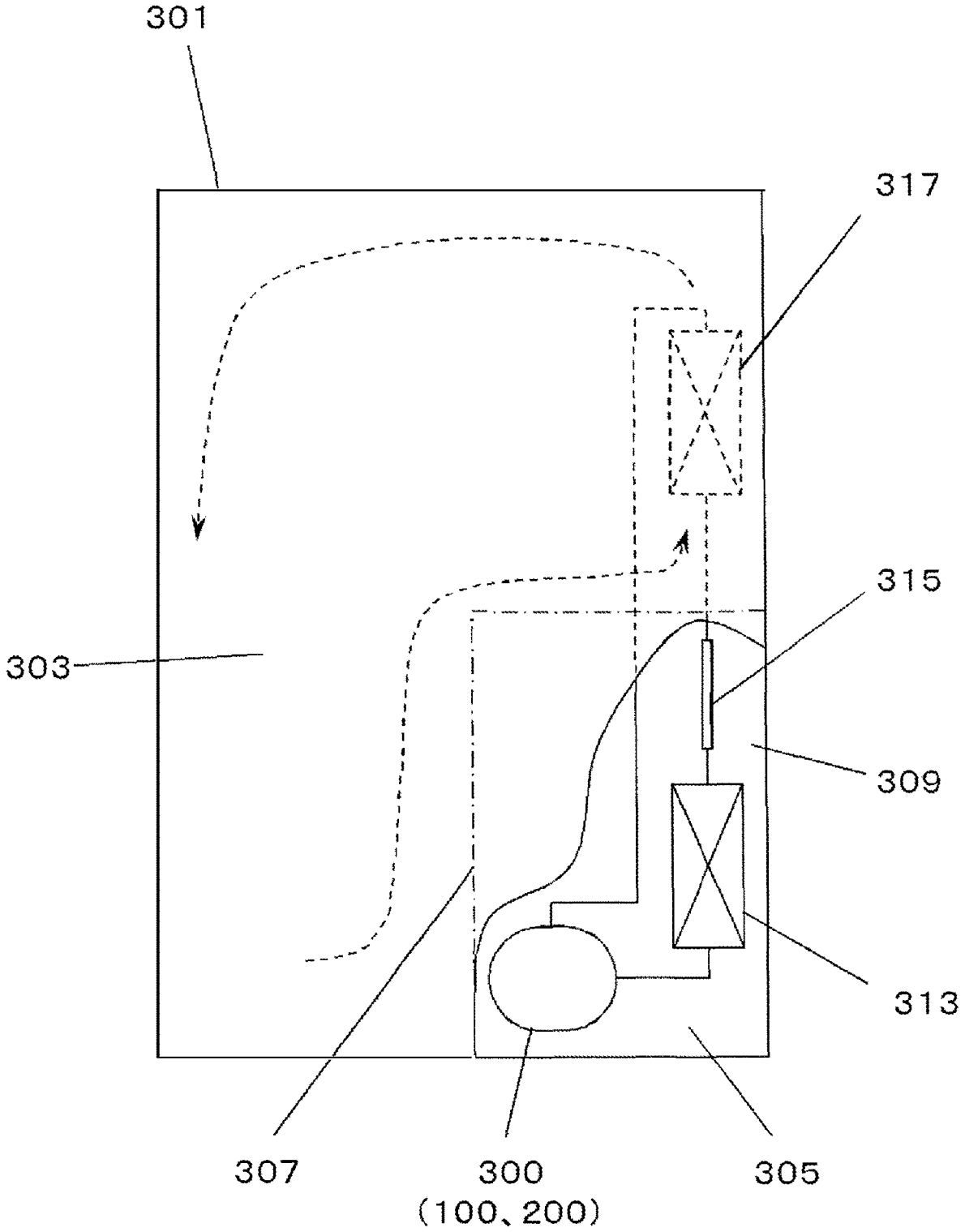
FIG. 10 is a diagram schematically showing a freezer according to Embodiment 3 of the present invention.

FIG. 10 shows the freezer including the refrigerant compressor 100 according to Embodiment 1 or the refrigerant compressor 200 according to Embodiment 2 as a refrigerant compressor 300. Herein, the basic configuration of the freezer will be schematically explained.

In FIG. 10, the freezer includes a main body 301, a partition wall 307, and a refrigerant circuit 309. The main body 301 includes: a heat-insulation box body including an opening on one surface thereof; and a door body configured to open and close the opening. The partition wall 307 divides the inside of the main body 301 into a storage space 303 for articles and a machine room 305. The refrigerant circuit 309 is configured such that a refrigerant compressor 300, a heat radiator 313, a decompressor 315, and a heat absorber 317 are annularly connected to one another by pipes. The refrigerant circuit 309 cools the inside of the storage space 303.

The heat absorber 317 is arranged in the storage space 303 including a blower (not shown). As shown by arrows in FIG. 10, cooling air of the heat absorber 317 is stirred by the blower so as to circulate in the storage space 303. Thus, the inside of the storage space 303 is cooled.

The freezer configured as above includes the refrigerant compressor 100 according to Embodiment 1 or the refrigerant compressor 200 according to Embodiment 2 as the refrigerant compressor 300. With this, the shaft part (the main shaft 209, the eccentric shaft 210) of the refrigerant compressor 300 includes the film having the hardness equal to or more than the hardness of the opposing bearing part (the main bearing 211, the eccentric bearing 219). Further, the bell mouths 170 are provided at the bearing part, or the crownings 270 are provided at the shaft part. With this, the abrasion resistance between the shaft part and the bearing part can be improved, and local contact/slide between the shaft part and the bearing part can be eased. Therefore, the power consumption of the freezer can be reduced. Thus, the energy saving is realized, and the reliability can be improved.

Embodiment 4

Configuration of Refrigerant Compressor

Figure 11:
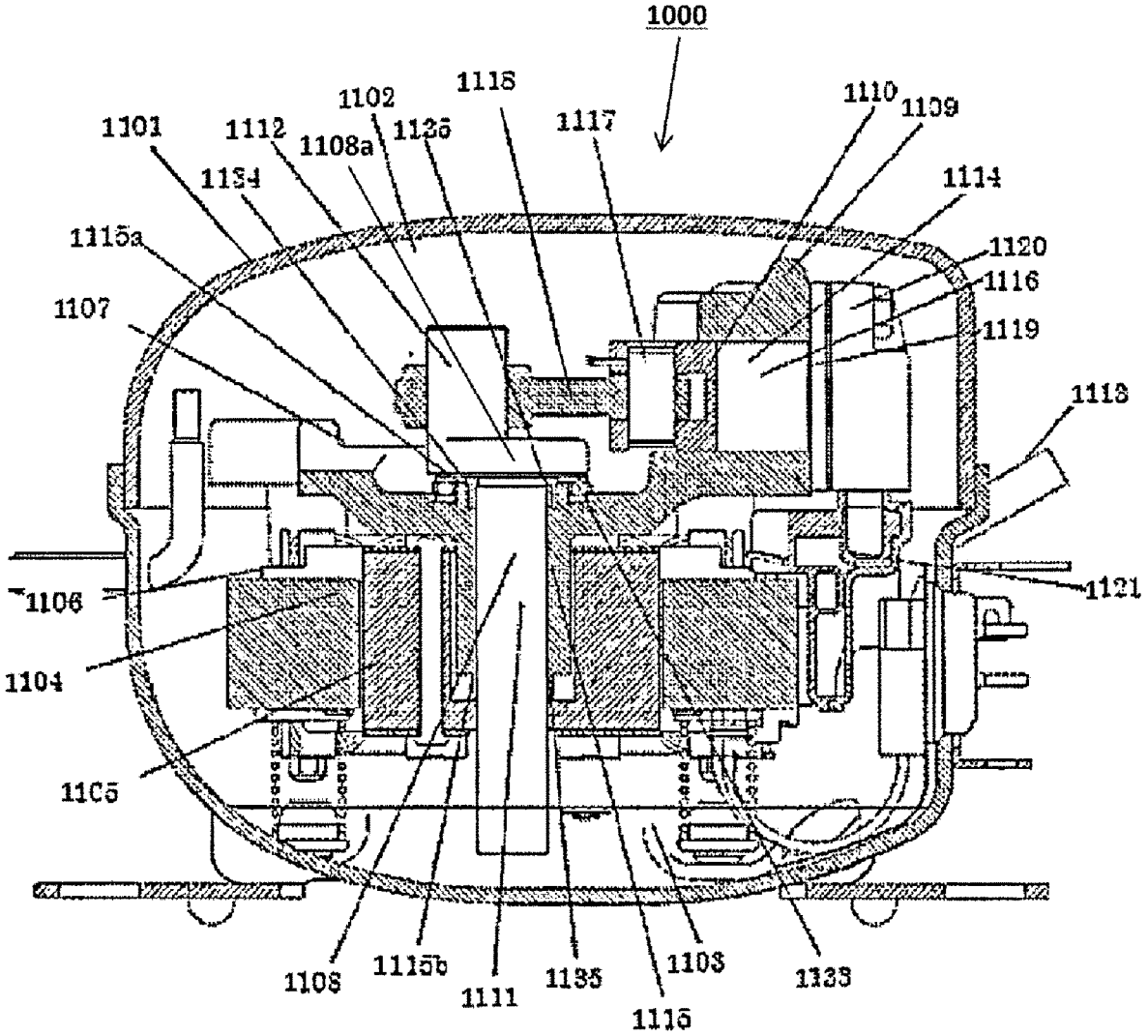
FIG. 11 is a sectional view schematically showing the refrigerant compressor according to Embodiment 4 of the present invention.

As shown in FIG. 11, a refrigerant compressor 1000 according to Embodiment 4 includes a sealed container 1101. The sealed container 1101 is filled with refrigerant gas 1102, and lubricating oil 1103 is stored in a bottom portion of the sealed container 1101. The sealed container 1101 accommodates an electric component 1106 and a compression component 1107. The electric component 1106 includes a stator 1104 and a rotor 1105. The compression component 1107 is driven by the electric component 1106 to compress the refrigerant. The compression component 1107 is, for example, a reciprocating compression mechanism and includes a crank shaft 1108, a cylinder block 1109, and a piston 1110.

The crank shaft 1108 includes a main shaft 1111, an eccentric shaft 1112, and a flange 1108*a*. The main shaft 1111 is a shaft part having a columnar shape. A lower portion of the main shaft 1111 is press-fitted and fixed to the rotor 1105, and an oil supply pump (not shown) communicating with the lubricating oil 1103 is provided at a lower end of the main shaft 1111. The eccentric shaft 1112 is a shaft part having a columnar shape and is arranged eccentrically with respect to the main shaft 109. The flange 1108*a* is located between the main shaft 1111 and the eccentric shaft 1112 to couple the main shaft 1111 and the eccentric shaft 1112.

The cylinder block 1109 is made of, for example, an iron-based material, such as cast iron, and includes a cylinder bore 1114, a main bearing 1115, and a thrust surface 1136. The cylinder bore 1114 is formed in a cylindrical shape and includes an internal space. An end surface of the cylinder bore 1114 is sealed by a valve plate 1119. The thrust surface 1136 is an annular surface extending in a direction perpendicular to the center axis of the main bearing 1115.

The main bearing 1115 is a bearing part having a cylindrical shape. An inner peripheral surface of the main bearing 1115 supports the main shaft 1111. The main bearing 1115 is a journal bearing supporting a radial load of the main shaft 1111. Therefore, the inner peripheral surface of the main bearing 1115 and an outer peripheral surface of the main shaft 1111 are opposed to each other, and the main shaft 1111 slides on the inner peripheral surface of the main bearing 1115. As above, a portion of the inner peripheral surface of the main bearing 1115 and a portion of the outer peripheral surface of the main shaft 1111 which portions slide on each other are sliding surfaces. The main bearing 1115 including the sliding surface and the main shaft 1111 including the sliding surface constitute a pair of sliding members.

The piston 1110 is made of an iron-based material, and one end portion of the piston 1110 is inserted in the internal space of the cylinder bore 1114 such that the piston 1110 can reciprocate. With this, a compression chamber surrounded by the cylinder bore 1114, the valve plate 1119, and the piston 1110 is formed. The other end portion of the piston 132 is coupled to the eccentric shaft 1112 by a coupler (connecting rod 1118) through a piston pin 1117. Further, the main shaft 1111 is coupled to the piston 132 through a connecting rod 1118 and the eccentric shaft 1112.

A cylinder head 1120 is fixed to the valve plate 1119 at an opposite side of the cylinder bore 1114. The cylinder head 1120 covers an ejection hole of the valve plate 1119 to form a high-pressure chamber (not shown). A suction tube 1113 is fixed to the sealed container 1101 and connected to a low-pressure side (not shown) of the refrigeration cycle. The suction tube 1113 introduces the refrigerant gas 1102 into the sealed container 1101. A suction muffler 1121 is sandwiched between the valve plate 1119 and the cylinder head 1120.

Film

Figure 12:
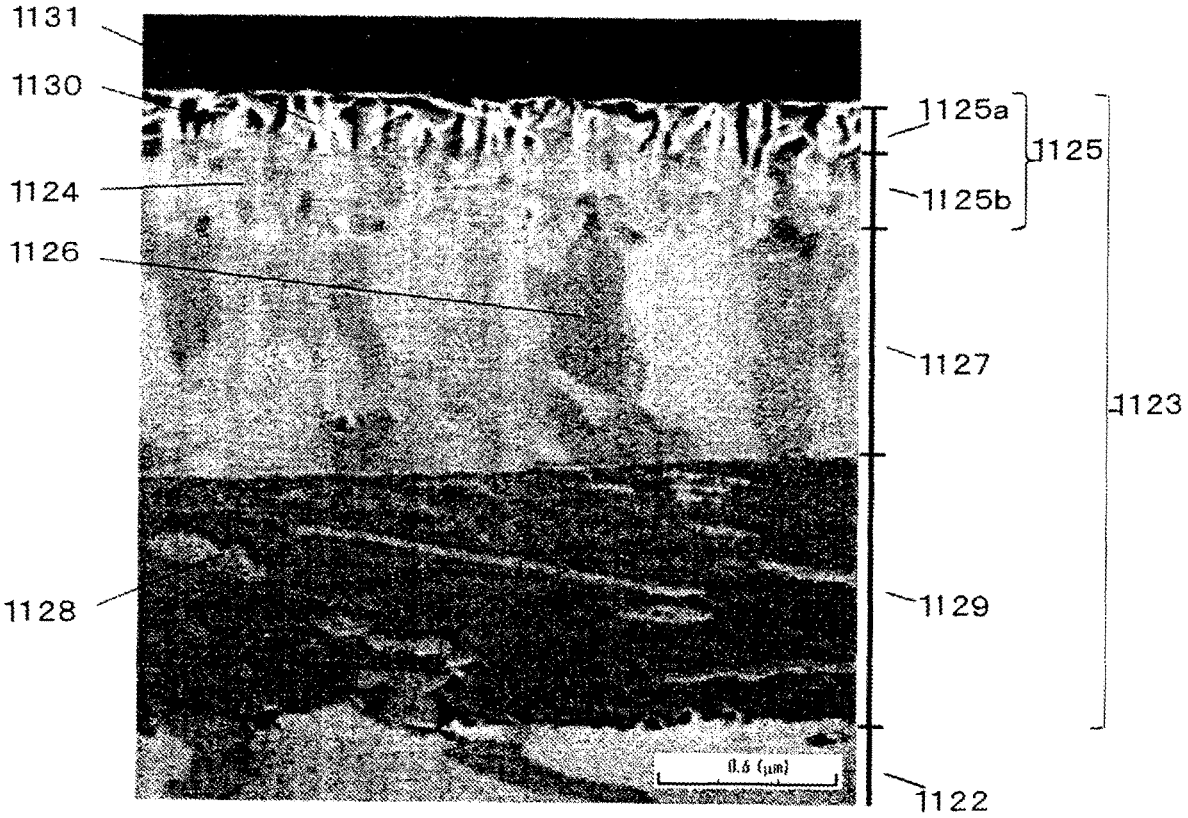
FIG. 12 is a SIM image showing one example of an observation result of the oxide film of FIG. 11 by the SIM (scanning ion microscope).

As shown in FIG. 12, the crank shaft 1108 is constituted by a base member 1122 and a film coating the surface of the base member 1122. The base member 1122 is formed by an iron-based material, such as gray cast iron. The film has the hardness equal to or more than the hardness of the main bearing 111 and the hardness of the eccentric bearing 119. One example of the film is an oxide film 1123. For example, the gray cast iron as the base member 1122 is oxidized by using known oxidizing gas, such as carbon dioxide gas, and a known oxidation facility at several hundreds of degrees Celsius (for example, 400 to 800° C.). With this, the oxide film 1123 can be formed on the surface of the base member 1122.

In the example of FIG. 12, a dimension (film thickness) of the oxide film 1123 in the vertical direction is about 3 μm. The oxide film 1123 includes a first portion 1125, a second portion 1127, and a third portion 1129, and these portions are laminated in this order from the surface toward the base member 1122. In FIG. 12, a protective film (resin film) for protecting an observation sample is formed on the first portion 151. A direction parallel to the surface of the oxide film 1123 is referred to as a lateral direction, and a direction perpendicular to the surface of the oxide film 160 is referred to as a vertical direction.

The first portion 1125 constitutes the surface of the oxide film 1123 and is formed on the second portion 1127. The first portion 1125 is formed by a structure of fine crystals. As a result of EDS (energy dispersive X-ray spectrometry) and EELS (electron ray energy loss spectrometry), a component contained most in the first portion 151 is diiron trioxide ($Fe_2O_3$), and the first portion 151 also contains a silicon (Si) compound. The first portion 1125 includes two portions (a first-a portion 1125*a* and a first-b portion 1125*b*) which are different in crystal density from each other.

The first-a portion 1125*a* is formed on the first-b portion 1125*b* and constitutes the surface of the oxide film 1123. The crystal density of the first-a portion 1125*a* is lower than the crystal density of the first-b portion 1125*b*. The first-a portion 1125*a* contains gap portions 1130 (black portions in FIG. 12) and acicular structures 1131. The acicular structures 1131 are vertically long. For example, a minor-axis length of the acicular structure 1131 in the lateral direction is 100 nm or less, and a ratio (aspect ratio) obtained by dividing the length in the vertical direction by the length in the lateral direction is 1 or more and 10 or less.

The first-b portion 1125*b* is a structure formed by spreading fine crystals 1124 having a particle diameter of 100 nm or less. Although the gap portions 1130 and the acicular structures 1131 are observed in the first-a portion 1125*a*, they are hardly observed in the first-b portion 1125*b*.

The second portion 1127 is formed on the third portion 1129 and contains a large number of vertically long columnar structures 1126 lined up in the same direction. For example, the length of the columnar structure 1126 in the vertical direction is about 100 nm or more and 1 μm or less, and the length of the columnar structure 1126 in the lateral direction is about 100 nm or more and 150 nm or less. The aspect ratio of the columnar structure 1126 is about 3 or more and 10 or less. According to the analytical results of the EDS and the EELS, a component contained most in the second portion 152 is triiron tetroxide ($Fe_3O_4$), and the second portion 152 also contains a silicon (Si) compound.

The third portion 1129 is formed on the base member 1122 and contains laterally long lamellar structures 1128. For example, the length of the lamellar structure 1128 in the vertical direction is several tens of nanometers or less, and the length of the lamellar structure 1128 in the lateral direction is about several hundreds of nanometers. The aspect ratio of the lamellar structure 1128 is 0.01 or more and 0.1 or less, i.e., the lamellar structure 1128 is long in the lateral direction. According to the analytical results of the EDS and the EELS, a component contained most in the third portion 1129 is triiron tetroxide ($Fe_3O_4$), and the third portion 1129 also contains a silicon (Si) compound and a silicon (Si) solid solution component.

In FIG. 12, the oxide film 1123 is constituted by the first portion 1125, the second portion 1127, and the third portion 1129, and the first, second, and third portions 1125, 1127, and 1129 are laminated in this order. However, the configuration of the oxide film 1123 and the order of the lamination are not limited to these.

For example, the oxide film 1123 may be constituted by a single layer that is the first portion 1125. The oxide film 1123 may be constituted by two layers that are the first portion 1125 and the second portion 1127 such that the first portion 1125 forms the surface of the oxide film 1123. The oxide film 1123 may be constituted by two layers that are the first portion 1125 and the third portion 1129 such that the first portion 1125 forms the surface of the oxide film 1123.

The oxide film 1123 may contain a composition other than the first portion 1125, the second portion 1127, and the third portion 1129. The oxide film 1123 may be constituted by four layers that are the first portion 1125, the second portion 1127, the first portion 1125, and the third portion 1129 such that the first portion 1125 forms the surface of the oxide film 1123.

The configuration of the oxide film 1123 and the order of the lamination are easily realized by adjusting conditions. A typical condition is a method of producing (forming) the oxide film 1123. A known method of oxidizing an iron-based material can be suitably used as the method of producing the oxide film 1123. However, the present embodiment is not limited to this. Conditions in the producing method are suitably set in accordance with conditions, such as the type of the iron-based material forming the base member 1122, the surface state (for example, polishing finish) of the base member 1122, and a physical property of the desired oxide film 1123.

Hardness

Figure 13:
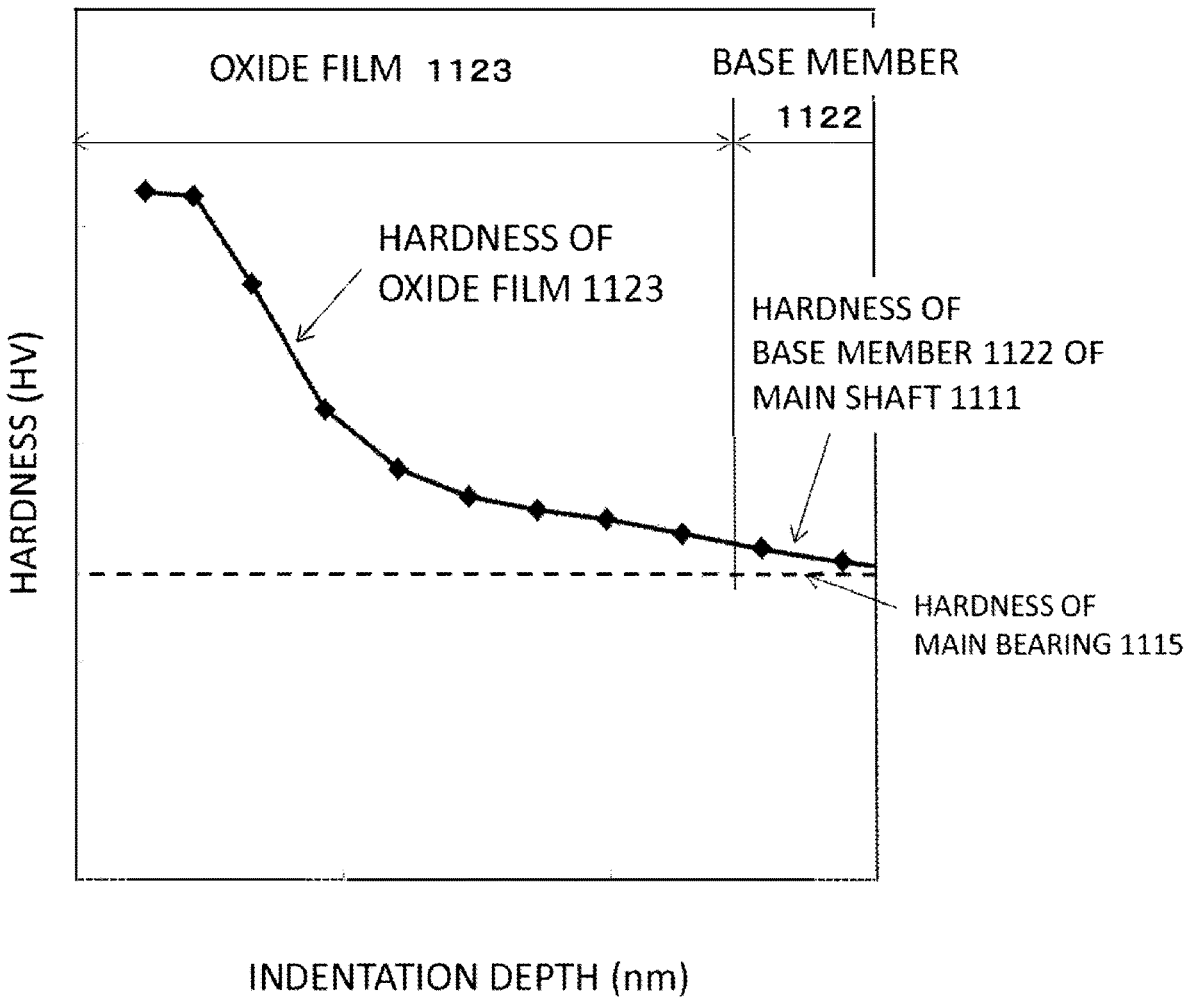
FIG. 13 is a graph showing the hardness of the crank shaft of FIG. 11 in the depth direction and the hardness of the main bearing of FIG. 11 in the depth direction.

FIG. 13 is a graph showing the hardness of the main shaft 1111 in the depth direction and the hardness of the main bearing 1115 in the depth direction. It should be noted that the hardness is shown by Vickers hardness. A nano indentation apparatus (triboindenter) produced by Scienta Omicron, Inc. is used for the measurement of the hardness.

Performed in the measurement of the hardness of the main shaft 1111 is a step in which: an indenter is pressed against the surface of the main shaft 1111 to apply a load to the surface for a certain period of time. Then, in the next step, the application of the load is stopped once, and the indenter is again pressed against the surface of the main shaft 1111 to apply a load higher than the previous load to the surface for a certain period of time. Such steps in which the applied loads are stepwisely increased are repeatedly performed 15 times. Further, the loads in the respective steps are set such that the highest load becomes 1 N. After each step, the hardness and depth of the oxide film 1123 and the hardness and depth of the base member 1122 in the main shaft 1111 are measured.

In the measurement of the hardness of the main bearing 1115, a part of the main bearing 1115 is cut by a fine cutter. The hardness of this part of the main bearing 1115 is measured by applying a load of 0.5 kgf to the inner peripheral surface of the main bearing 1115 by using the indenter.

As a result, the hardness of the oxide film 1123 of the main shaft 1111 is equal to or more than the hardness of the main bearing 1115 that is an opponent sliding member.

The hardness is one of mechanical properties of the surface of an object, such as a substance or a material, or the vicinity of the surface of the object. The hardness denotes the unlikelihood of the deformation of the object and the unlikelihood of the damage of the object when external force is applied to the object. Regarding the hardness, there are various measurement means (definitions) and their corresponding values (measures of the hardness). Therefore, the measurement means corresponding to a measurement target may be used.

For example, when the measurement target is a metal or a nonferrous metal, an indentation hardness test method (such as the above-described nano indentation method, the Vickers hardness method, or the Rockwell hardness method) is used for the measurement.

Further, for the measurement targets, such as resin films and phosphate films, which are difficult to be measured by the indentation hardness test method, an abrasion test such as a ring-on-disk test is used. In one example of this measurement method, a test piece is prepared by forming a film on the surface of a disk. With the test piece immersed in oil, the test piece is rotated at a rotational speed of 1 m/s for an hour while applying a load of 1000 N to the film by a ring. With this, the ring slides on the film. The state of the sliding surface of the film and the state of the sliding surface of the surface of the ring are observed. As a result, it may be determined that one of the ring and the film which one is larger in abrasion loss has lower hardness.

Rigidity

Figure 14:
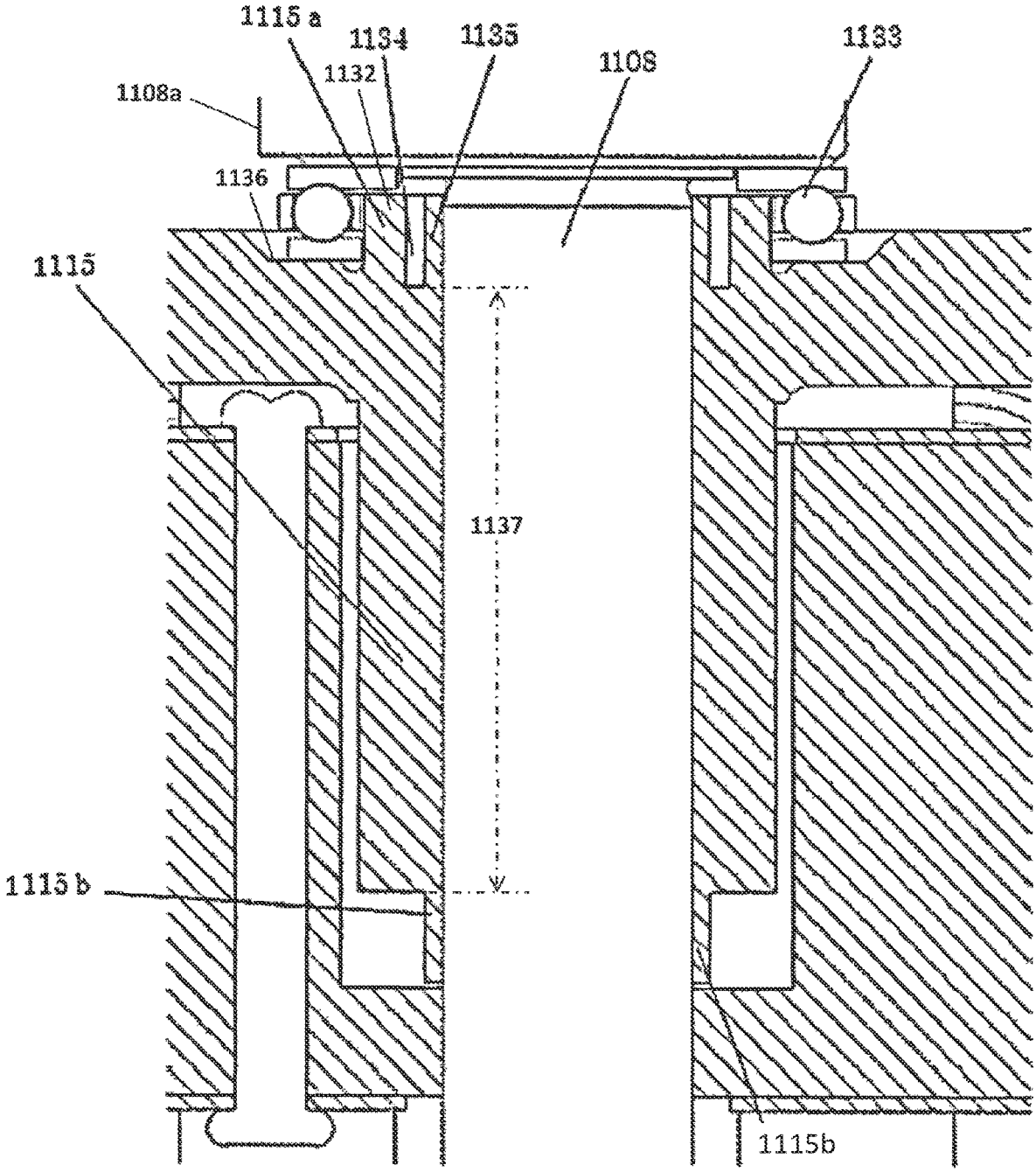
FIG. 14 is an enlarged view showing the main bearing of FIG. 11.

As shown in FIG. 14, the main bearing 1115 has a substantially cylindrical shape and includes one end portion (upper end portion 1115*a*), the other end portion (lower end portion 1115*b*), and an intermediate portion 1137. The intermediate portion 1137 is a portion located between the upper end portion 1115*a* and the lower end portion 1115*b* and having a constant radial dimension (thickness) in an axial direction. Inner peripheral surfaces of the upper end portion 1115*a*, the lower end portion 1115*b*, and the intermediate portion 1137 are continuous in the axial direction. The upper end portion 1115*a*, the lower end portion 1115*b*, and the intermediate portion 1137 are provided parallel to the center axis of the main bearing 1115.

The upper end portion 1115*a* has a cylindrical shape, and the thrust surface 1136 spreads in the radial direction from an outer peripheral edge of the upper end portion 1115*a*. A thrust ball bearing 1133 is arranged between the thrust surface 1136 and the flange 1108*a* of the crank shaft 1108. The thrust ball bearing 1133 has a cylindrical shape and is arranged so as to surround the upper end portion 1115*a*. The thrust ball bearing 1133 supports a load of the crank shaft 1108 in the vertical direction.

The upper end portion 1115*a* is arranged closer to the center axis of the main bearing 1115 than the thrust surface 1136 and projects upward from the thrust surface 1136. The upper end portion 1115*a* is inserted into the thrust ball bearing 1133. An axial dimension (height) of the main bearing 1115 is lower than the height of the thrust ball bearing 1133.

A slit groove 1134 is provided at the upper end portion 1115*a*. The slit groove 1134 has an annular shape and is provided coaxially with the upper end portion 1115*a*. With this, the slit groove 1134 divides the upper end portion 1115*a* into two parts. Therefore, the upper end portion 1115*a* is divided into a first end portion 1132 located outside the slit groove 1134 (at an opposite side of the center axis) and a second end portion 1135 located inside the slit groove 1134 (at the center axis side). Each of the first end portion 1132 and the second end portion 1135 has a cylindrical shape. The first end portion 1132 and the second end portion 1135 are arranged coaxially. A radial dimension (thickness) of the first end portion 1132 and a radial dimension (thickness) of the second end portion 1135 are uniform over the entire periphery in the circumferential direction. The second end portion 1135 is smaller in diameter than the first end portion 1132.

The second end portion 1135 is a thin portion having a radial dimension (thickness) that is smaller than each of the thickness of the first end portion 1132 and the thickness of the intermediate portion 1137. With this, the second end portion 1135 is a low-rigidity portion that is lower in rigidity than the intermediate portion 1137.

The lower end portion 1115*b* has a cylindrical shape, and the thickness of the lower end portion 1115*b* is uniform over the entire periphery in the circumferential direction. The outer diameter of the lower end portion 1115*b* is reduced by a step portion. The lower end portion 1115*b* is a thin portion having a radial dimension (thickness) that is smaller than the thickness of the intermediate portion 1137. With this, the lower end portion 1115*b* is a low-rigidity portion that is lower in rigidity than the intermediate portion 1137.

As above, each of both end portions of the main bearing 1115 serves as the thin portion and the low-rigidity portion by the second end portion 1135 or the lower end portion 1115*b*. An inner peripheral surface of the second end portion 1135 and the inner peripheral surface of the lower end portion 1115*b* support the main shaft 1111 inserted into the second end portion 1135 and the lower end portion 1115*b*.

Operations of Refrigerant Compressor

Electric power supplied from a commercial power supply (not shown) is supplied to the electric component 1106 through an external inverter drive circuit (not shown). With this, the electric component 1106 is inverter-driven at a plurality of operation frequencies, and the rotor 1105 of the electric component 1106 rotates the crank shaft 1108. The eccentric motion of the eccentric shaft 1112 of the crank shaft 1108 is converted into the linear motion of the piston 1110 by the connecting rod 1118 and the piston pin 1117, and the piston 1110 reciprocates in the compression chamber 1116 of the cylinder bore 1114. Therefore, the refrigerant gas introduced through the suction tube 1113 into the sealed container 1101 is sucked in the compression chamber 1116 from the suction muffler 1121. Then, the refrigerant gas is compressed in the compression chamber 1116 and ejected from the sealed container 1101.

In accordance with the rotation of the crank shaft 1108, the lubricating oil 1103 is supplied from the oil supply pump to the sliding surfaces to lubricate the sliding surfaces. In addition, the lubricating oil 1103 forms a seal between the piston 1110 and the cylinder bore 1114 to seal the compression chamber 1116.

Actions and Effects

In order to increase the efficiency of the refrigerant compressor in recent years, the viscosity of the lubricating oil 1103 is reduced, and the slide length of the sliding member is reduced. Therefore, the slide condition becomes severer, and the decrease in thickness of the oil film and the break of the oil film tend to occur between the sliding members.

A large number of minute projections exist on both the main shaft 1111 and the main bearing 1115. According to the configuration of the conventional refrigerant compressor, when the main shaft inclines in the main bearing, local contact occurs between the upper end portion of the main shaft and the main bearing and between the lower end portion of the main shaft and the main bearing, and the surface pressure becomes high. Further, when the refrigerant compressor is operated by inverter drive at a low speed (for example, less than 20 Hz), the oil film between the main shaft and the main bearing becomes thin, and the solid contact by the projections frequently occurs. In addition, when the oxide film having high abrasion resistance is formed on the surface of the main shaft, the projections on the surface hardly abrade, and the contact between the main shaft and the main bearing hardly becomes smooth. As a result, it is thought that the time of occurrence of the solid contact increases. Thus, it is thought that the initial input becomes high, and in addition, the transition time from the initial input to the steady input increases.

On the other hand, according to the refrigerant compressor of the present embodiment, the rigidity of the second end portion 1135 of the main bearing 1115 and the rigidity of the lower end portion 1115*b* of the main bearing 1115 are made lower than the rigidity of the intermediate portion 1137 of the main bearing 1115. With this, when a load is applied from the main shaft 1111 to the main bearing 1115, the second end portion 1135 and the lower end portion 1115*b* elastically deform. Therefore, local contact between the main shaft 1111 and the main bearing 1115 is eased, and the decrease in thickness of the oil film and the break of the oil film are suppressed between the main shaft 1111 and the main bearing 1115. On this account, the initial input is made low even during the low-speed operation (for example, less than 20 Hz), and the transition time from the initial input to the steady input is shortened. Further, since the oxide film 1123 having high abrasion resistance is formed on the surface of the main shaft 1111, the durability of the refrigerant compressor can also be secured.

Even when the second end portion 1135 deforms, this deformation occurs in the slit groove 1134. With this, a load by the deformation of the second end portion 1135 does not act on the first end portion 1132 arranged such that the slit groove 1134 is sandwiched between the first end portion 1132 and the second end portion 1135. Therefore, the first end portion 1132 does not deform, so that the positioning error and deformation of the thrust ball bearing 1133 supported by the first end portion 1132 can be prevented.

Further, the second end portion 1135 as the low-rigidity portion and the first end portion 1132 supporting the thrust ball bearing 1133 are formed by the slit groove 1134. Since the number of parts does not increase, the cost increase can be suppressed.

The oxide film 1123 includes the first portion 1125, the second portion 1127, and the third portion 1129. By the oxide film 1123, the main shaft 1111 becomes hard and obtains improved abrasion resistance. In addition, the attacking property (opponent attacking property) of the main shaft 1111 with respect to the main bearing 1115 is reduced, and the contact property of the main shaft 1111 at the initial stage of the sliding operation also improves. Therefore, in combination with the effect obtained by reducing the rigidity of the end portions of the main bearing 1115, the highly-efficient operation in which the input to the refrigerant compressor is low from the initial stage of the operation is realized.

Details of the increase in the abrasion resistance of the oxide film 1123, the reduction in the opponent attacking property of the oxide film 1123, and the improvement of the contact property of the oxide film 1123 at the initial stage of the sliding operation are described in Japanese Patent Application Nos. 2016-003910 and 2016-003909 filed by the present applicant. One of the reasons for these may be as below.

Since the oxide film 1123 is an oxide of iron, the oxide film 1123 is chemically more stable than the conventional phosphate film. Further, the film of the oxide of iron has higher hardness than the phosphate film. Therefore, by the formation of the oxide film 1123 on the sliding surface, the generation, adhesion, and the like of the abrasion powder can be effectively prevented. As a result, the increase in the abrasion loss of the oxide film 1123 itself can be effectively avoided, and the oxide film 1123 exhibits high abrasion resistance.

In addition, the first portion 1125 contains the silicon (Si) compound having higher hardness than the oxide of iron. Since the surface of the oxide film 1123 is constituted by the first portion 1125 containing the silicon (Si) compound, the oxide film 1123 can exhibit higher abrasion resistance.

A component contained most in the first portion 1125 constituting the surface of the oxide film 1123 is diiron trioxide ($Fe_2O_3$). The crystal structure of diiron trioxide ($Fe_2O_3$) is rhombohedron, and the surface of the crystal structure of diiron trioxide ($Fe_2O_3$) is more flexible than the cubic crystal structure of triiron tetroxide ($Fe_3O_4$) located under the crystal structure of diiron trioxide ($Fe_2O_3$) and the crystal structures of a dense hexagonal crystal, face-centered cubic crystal, and body-centered tetragonal crystal of a nitriding film. Therefore, it is thought that the first portion 1125 containing a large amount of diiron trioxide ($Fe_2O_3$) has more appropriate hardness, lower opponent attacking property, and better contact property at the initial stage of the sliding operation than a conventional gas nitriding film or a typical oxide film (triiron tetroxide ($Fe_3O_4$) film).

To be specific, the surface of the oxide film 1123 constituting the surface of the main shaft 1111 contains a large amount of diiron trioxide ($Fe_2O_3$) that is relatively hard, has the rhombohedral crystal structure, and is flexible. Therefore, the opponent attacking property is reduced, and the break of the oil film and the like are suppressed. Further, the contact property at the initial stage of the sliding operation improves. In addition, in combination with the effect obtained by providing the bell mouth 170 at the main bearing 111, the highly-efficient operation in which the input to the refrigerant compressor is low from the initial stage of the operation is realized.

Further, the second portion 1127 and third portion 1129 of the oxide film 1123 contain the silicon (Si) compound and are located between the first portion 1125 and the base member 1122. Therefore, adhesive force of the oxide film 1123 with respect to the base member 1122 becomes strong. In addition, the amount of silicon contained in the third portion 1129 is larger than that in the second portion 1127. As above, the second portion 1127 containing the silicon (Si) compound and the third portion 1129 containing the silicon (Si) compound are laminated, and the third portion 153 containing a larger amount of silicon contacts the base member 150. With this, the adhesive force of the oxide film 1123 can be further increased. As a result, the proof stress of the oxide film 1123 with respect to the load at the time of the sliding operation improves, and the abrasion resistance of the oxide film 1123 further improves. Even if the first portion 1125 forming the surface of the oxide film 1123 abrades, the second portion 1127 and the third portion 1129 remain, so that the oxide film 1123 exhibits more excellent abrasion resistance.

Further, from a different point of view, it is thought that the increase in the abrasion resistance of the oxide film 1123, the reduction in the opponent attacking property of the oxide film 1123, and the improvement of the contact property of the oxide film 1123 at the initial stage of the sliding operation are realized by the following reasons.

To be specific, the first portion 1125 constituting the surface of the oxide film 1123 contains the silicon (Si) compound, and in addition, has a dense fine crystal structure. Therefore, the oxide film 1123 exhibits high abrasion resistance.

The first portion 1125 has the fine crystal structure, and the slight minute gap portions 1130 are formed in some places among the fine crystals, or minute depressions and projections are formed on the surface of the first portion 1125. Therefore, the lubricating oil 1103 is easily held on the surface (sliding surface) of the oxide film 1123 by capillarity. To be specific, since there are the slight minute gap portions 1130 and/or the minute depressions and projections, the lubricating oil 1103 can be held on the sliding surfaces even under a severe sliding state, i.e., so-called "oil holding property" can be exhibited. As a result, the oil film is easily formed on the sliding surface.

Further, in the oxide film 1123, the columnar structures 1126 (second portion 1127) and the lamellar structures 1128 (third portion 1129) exist under the first portion 1125 and closer to the base member 1122. These structures are lower in hardness and softer than the fine crystals 1124 of the first portion 1125. Therefore, during the sliding operation, the columnar structures 1126 and the lamellar structures 1128 serve as "cushioning materials." With this, by the pressure applied to the surface of the fine crystals 1124 during the sliding operation, the fine crystals 1124 behave so as to be compressed toward the base member 1122. As a result, the opponent attacking property of the oxide film 1123 is significantly lower than that of the other surface treated films, and therefore, the abrasion of the sliding surface of the opponent member is effectively suppressed.

It should be noted that the function of the "cushioning materials" is exhibited even if only one of the second portion 1127 and the third portion 1129 is provided. Therefore, the second portion 1127 or the third portion 1129 is only required to be located under the first portion 1125. It is preferable that both the second portion 1127 and the third portion 1129 be located under the first portion 1125.

The oxide film 1123 has the low opponent attacking property and can exhibit the satisfactory "oil holding property." Therefore, an oil film forming ability of the shaft part including the oxide film 1123 significantly improves. By the high oil film forming ability in combination with the effect obtained by reducing the rigidity of the end portions of the main bearing 1115, the highly-efficient operation in which the input to the refrigerant compressor is low from the initial stage of the operation is realized.

MODIFIED EXAMPLE

In the above configurations, the second end portion 1135 and the lower end portion 1115*b* as the low-rigidity portions are respectively formed at both end portions of the main bearing 1115. However, the low-rigidity portion may be formed at any one of both end portions of the main bearing 1115. To be specific, the main bearing 1115 may include the second end portion 1135 or the lower end portion 1115*b*.

In all the above configurations, the second end portion 1135 as the low-rigidity portion is formed by the slit groove 1134, and the lower end portion 1115*b* having low rigidity is formed by the step portion. However, the method of forming the low-rigidity portions is not limited to this.

In all the above configurations, the slit groove 1134 has an annular shape. However, the shape of the slit groove 1134 is not limited to this as long as the low-rigidity portion is formed at one end portion of the main bearing 1115.

In all the above configurations, the low-rigidity portion is provided at each of the second end portion 1135 and the lower end portion 1115*b* over the entire periphery in the circumferential direction. However, the range of the low-rigidity portion is not limited to this. For example, the low-rigidity portion may be provided at each of a region of the second end portion 1135 and a region of the lower end portion 1115*b* to which regions a maximum load is applied by the main shaft 1111. Therefore, the region of the second end portion 1135 may be made smaller in thickness than the other region of the second end portion 1135 in the circumferential direction, and the region of the lower end portion 1115*b* may be made smaller in thickness than the other region of the lower end portion 1115*b* in the circumferential direction.

In all the above configurations, the slit groove 1134 is provided coaxially with the main hearing 1115. However, the position of the slit groove 1134 is not limited to this. For example, the slit groove 1134 may be arranged eccentrically with respect to the main bearing 1115 such that a region of the main bearing 1115 on which region the maximum load of the main shaft 1111 acts in the circumferential direction is made smaller in thickness than the other region of the main bearing 1115. With this, the amount of elastic deformation of the low-rigidity portion of the main bearing 1115 becomes maximum in a direction in which the maximum load of the main shaft 1111 acts. Therefore, the oil film between the main shaft 1111 and the main bearing 1115 can be made uniform in the circumferential direction.

In all the above configurations, the oxide film 1123 is included on the surface of the main shaft 1111. However, the film on the surface of the main shaft 1111 is not limited to this as long as the film has hardness equal to or more than the hardness of the main bearing 1115. Examples of the film of the main shaft 1111 include a compound layer, a mechanical strength improved layer, and a layer formed by a coating method.

To be specific, when the base member 1122 of the shaft part is an iron-based member, the film may be a film formed by a typical quenching method and a method of impregnating a surface layer with carbon, nitrogen, or the like. Further, the film may be a film formed by an oxidation treatment using steam and an oxidation treatment of performing immersion in a sodium hydroxide aqueous solution. Furthermore, the film may be a layer (mechanical strength improved layer) which is formed by cold working, work hardening, solute strengthening, precipitation strengthening, dispersion strengthening, and grain refining and in which a slip motion of a dislocation is suppressed, and the base member 150 is strengthened. Further, the film may be a layer formed by a coating method, such as plating, thermal spraying, PVD, or CVD.

In all the above configurations, the iron-based material is used as the material of the base member 150 of the shaft part. However, a material other than the iron-based material may be used as the material of the base member 150 as long as a film having hardness equal to or more than the hardness of the bearing part can be formed.

In the present embodiment, the low-rigidity portion of the main bearing 1115 is formed by reducing the thickness of the main bearing 1115. However, low-rigidity parts (for example, resin bushings) may be provided at the upper and lower end portions of the main bearing 1115, and this brings about the same effects as above.

In the present embodiment, the low-rigidity portions of the main bearing 1115 are provided at the upper end portion 1115*a* and lower end portion 1115*b* of the main bearing 1115. However, even if the low-rigidity portion is formed at any one of the upper and lower end portions, a certain degree of effect can be expected.

In the present embodiment, the low-rigidity portions are formed at the upper end portion 1115*a* and lower end portion 1115*b* of the main bearing 1115. Even when the low-rigidity portions are formed at the upper and lower end portions of the connecting rod 1118 into which the eccentric shaft 1112 is inserted, the same effect as above can be obtained.

In all the above configurations, the effects in an example in which the refrigerant compressor is driven by the low-speed operation (for example, at the operation frequency of 17 Hz) are explained. However, the operation of the refrigerant compressor is not limited to this. Even when the refrigerant compressor performs the operation at a commercial rotational frequency or the high-speed operation at a high rotational frequency, the performance and reliability of the refrigerant compressor can be improved as with when the refrigerant compressor performs the low-speed operation.

In all the above configurations, the refrigerant compressor is a reciprocating type. However, the refrigerant compressor may be the other type, such as a rotary type, a scroll type, or a vibration type. The configuration in which the shaft part includes the film having the hardness equal to or more than the hardness of the bearing part is not limited to the refrigerant compressor and may be used in an apparatus including sliding surfaces, and with this, the same effects can be obtained. Examples of the apparatus including the sliding surfaces include a pump and a motor.

Embodiment 5

Figure 15:
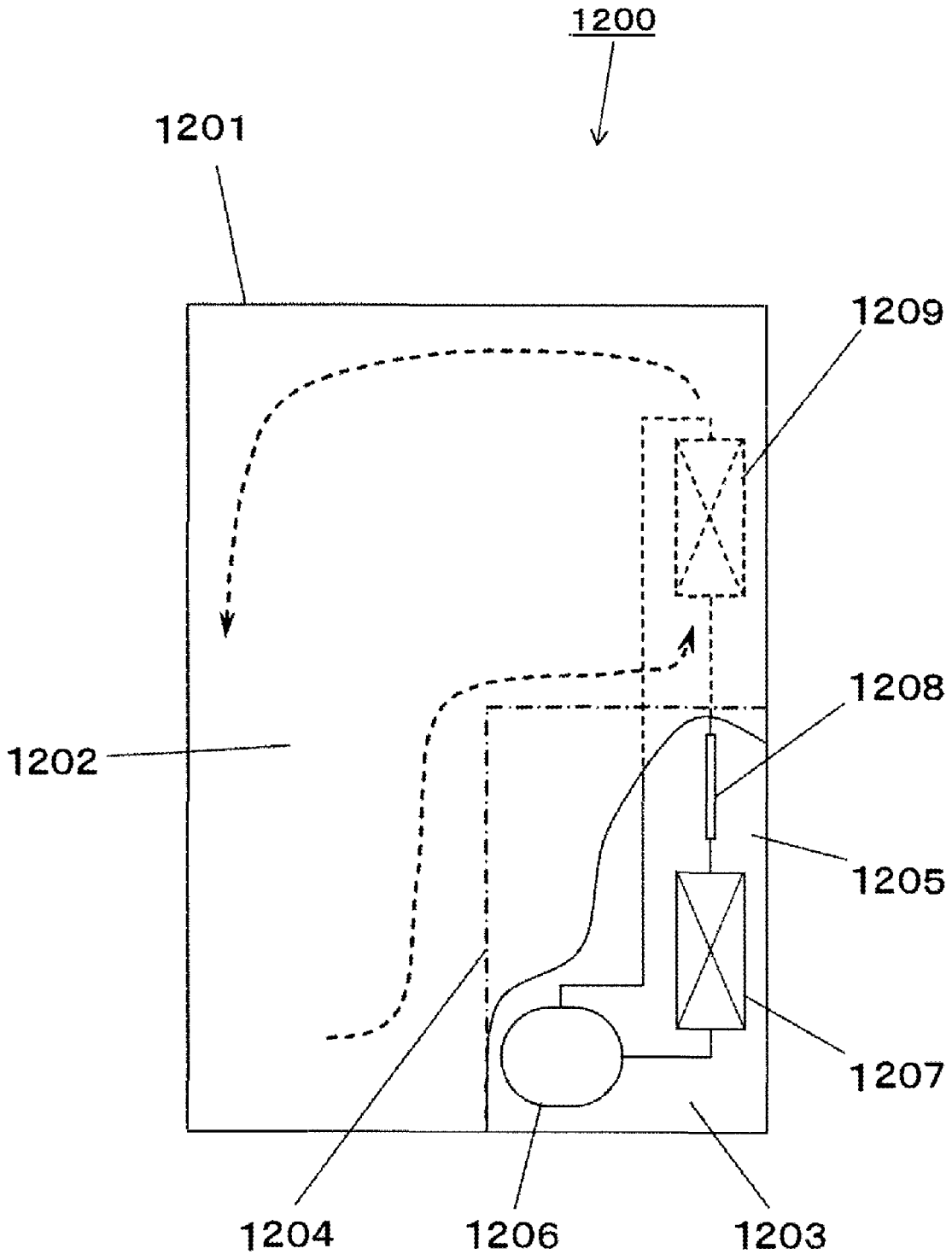
FIG. 15 is a diagram schematically showing the freezer according to Embodiment 5 of the present invention.
Figure 16:
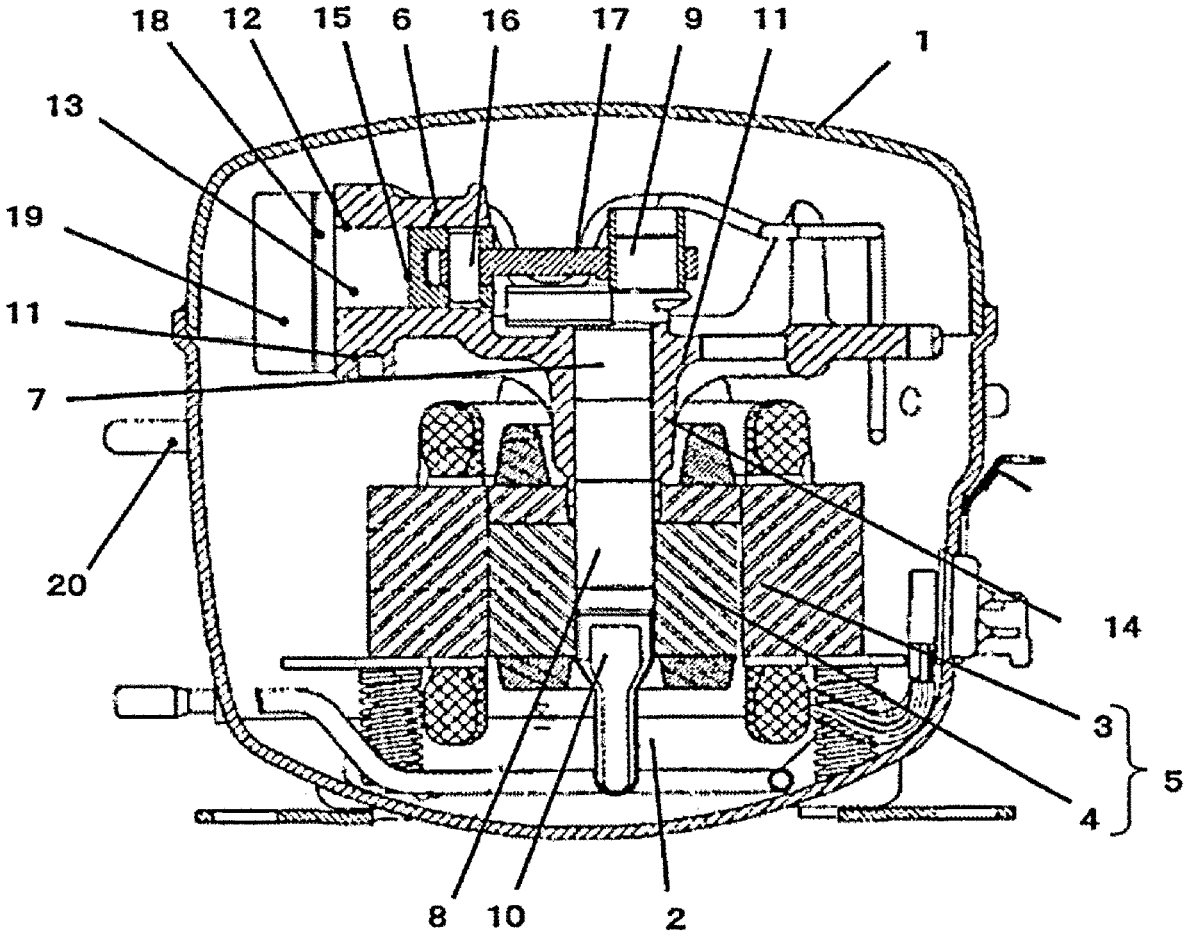
FIG. 16 is a sectional view schematically showing a conventional refrigerant compressor.

FIG. 15 is a schematic diagram showing the configuration of the freezer according to Embodiment 5 of the present invention. Herein, the refrigerant compressor according to Embodiment 4 is used as a refrigerant circuit of the freezer. The basic configuration of the freezer will be schematically explained.

In FIG. 9, a freezer 1200 includes a main body 1201, a partition wall 1204, and a refrigerant circuit 1205. The main body 1201 includes: a heat-insulation box body including an opening on one surface thereof; and a door body configured to open and close the opening. The partition wall 1204 divides the inside of the main body 1201 into a storage space 1202 for articles and a machine room 1203. The refrigerant circuit 309 is configured such that a refrigerant compressor 1206, a heat radiator 1207, a decompressor 1208, and a heat absorber 1209 are annularly connected to one another by pipes. The refrigerant circuit 309 cools the inside of the storage space 1202.

The heat absorber 1209 is arranged in the storage space 1202 including a blower (not shown). As shown by broken line arrows in FIG. 15, cooling air of the heat absorber 1209 is stirred by the blower so as to circulate in the storage space 1202. Thus, the inside of the storage space 1202 is cooled.

The freezer 1200 configured as above includes the refrigerant compressor according to Embodiment 4 as the refrigerant compressor 1206. With this, the film of the main shaft 1111 of the refrigerant compressor 1206 has the hardness equal to or more than the hardness of the opposing main bearing 1115, and the rigidity of the end portions of the main bearing 1115 is made lower than the rigidity of the intermediate portion of the main bearing 1115. Therefore, the improvement of the abrasion resistance, the reduction in the local contact/slide, and the keeping of the formation of the oil film are realized between the main shaft 1111 and the main bearing 1115. On this account, the performance of the refrigerant compressor 1206 improves, so that the energy saving by the reduction in the power consumption of the freezer 1200 is realized, and the reliability can be improved.

The foregoing has explained the refrigerant compressor according to the present invention and the freezer including the refrigerant compressor according to the present invention based on the above embodiments. However, the present invention is not limited to these. To be specific, the embodiments disclosed herein are merely illustrative in all aspects and should not be recognized as being restrictive. The scope of the present invention is defined by the scope of the claims, not by the above description, and is intended to include meaning equivalent to the scope of the claims and all modifications within the scope.

INDUSTRIAL APPLICABILITY

As above, the present invention can provide a refrigerant compressor whose efficiency is prevented from deteriorating, and a freezer including the refrigerant compressor. Therefore, the present invention is widely applicable to various apparatuses using the refrigeration cycle.

REFERENCE SIGNS LIST

100 refrigerant compressor
101 sealed container
106 electric component
107 compression component
109 main shaft (shaft part)
109*a* second sliding surface (sliding surface)
109*b* extended surface
110 eccentric shaft (shaft part)
110T corner
111 main bearing (bearing part)
111*a* center axis
111*b* first sliding surface (sliding surface)
119 eccentric bearing (bearing part)
160 oxide film (film)
170 bell mouth (curved-surface portion)
200 refrigerant compressor
207 compression component
209 main shaft (shaft part)
209*a* center axis
209*b* second sliding surface (sliding surface)
210 eccentric shaft (shaft part)
211 main bearing (bearing part)
211T corner
211*a* first sliding surface (sliding surface)
219 eccentric bearing (bearing part)
270 crowning (curved-surface portion)
300 refrigerant compressor
1000 refrigerant compressor
1101 sealed container
1106 electric component
1107 compression component
1108 crank shaft
1109 cylinder block
1111 main shaft
1112 eccentric shaft
1115 main bearing
1115*a* upper end portion (one end portion)
1115*b* lower end portion (the other end portion)
1123 oxide film (film)
1132 first end portion
1133 thrust ball bearing (ball bearing)
1134 slit groove
1135 second end portion
1136 thrust surface
1137 intermediate portion
1200 freezer

The invention claimed is:

1. A refrigerant compressor comprising:
an electric component;
a compression component driven by the electric component to compress a refrigerant; and
a sealed container accommodating the electric component and the compression component, wherein:
the compression component includes
a shaft part rotated by the electric component and
a bearing part slidingly contacting the shaft part such that the shaft part is rotatable;
an inner peripheral surface of the bearing part includes
a sliding surface,
a chamfered surface provided closer to an end of the bearing part than the sliding surface in a center axis direction of the bearing part, and
a corner between the sliding surface and the chamfered surface;
an outer peripheral surface of the shaft part includes
a sliding surface and
a small-diameter portion which is provided closer to an end of the shaft part than the sliding surface of the shaft part in a center axis direction of the shaft part, is smaller in diameter than the sliding surface, and is opposed to the corner and the chamfered surface in a direction perpendicular to the center axis direction of the shaft part, the chamfered surface being adjacent to the small-diameter portion;
the sliding surface of the shaft part includes a curved-surface portion having an outer diameter that continuously decreases in a curved shape toward the end of the shaft part in the center axis direction of the shaft part; and the small-diameter portion is connected to the curved-surface portion in a step shape.

2. The refrigerant compressor according to claim 1, wherein the small-diameter portion is a non-sliding portion.

3. The refrigerant compressor according to claim 1, wherein the small-diameter portion includes a surface parallel to a center axis of the shaft part.

4. The refrigerant compressor according to claim 1, wherein a film having hardness equal to or more than hardness of the sliding surface of the bearing part is provided on the sliding surface of the shaft part.

5. The refrigerant compressor according to claim 1, wherein in a plane passing through a center axis of the shaft part, the curved-surface portion has a shape approximated by a logarithmic function.

6. The refrigerant compressor according to claim 1, wherein the curved-surface portion of the shaft part is formed such that in a plane passing through a center axis of the shaft part, a ratio of a dimension D of the curved-surface portion of the shaft part in the direction perpendicular to the center axis direction of the shaft part to a dimension C of the curved-surface portion of the shaft part in the center axis direction of the shaft part is 1/5000 or more and 1/50 or less.

7. The refrigerant compressor according to claim 1, wherein:

the shaft part includes a main shaft and an eccentric shaft arranged eccentrically with respect to the main shaft; and the bearing part includes a main bearing supporting the main shaft such that the main shaft is rotatable and an eccentric bearing supporting the eccentric shaft such that the eccentric shaft is rotatable.

8. The refrigerant compressor according to claim 1, wherein the electric component is configured to be inverter-driven at a plurality of operation frequencies including frequencies of less than 20 Hz.

9. A freezer comprising:

a heat radiator;

a decompressor;

a heat absorber; and the refrigerant compressor according to claim 1.

* * * * *